US008066136B2

(12) United States Patent
Turvey et al.

(10) Patent No.: US 8,066,136 B2
(45) Date of Patent: Nov. 29, 2011

(54) COLLAPSIBLE STORAGE DEVICE

(75) Inventors: Robert R. Turvey, Sanford, MI (US); Brian C. Dais, Saginaw, MI (US); Sanjay Dhall, Canton, MI (US); Craig R. Gosen, Sanford, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 884 days.

(21) Appl. No.: 11/811,983

(22) Filed: Jun. 13, 2007

(65) Prior Publication Data

US 2008/0000901 A1 Jan. 3, 2008

Related U.S. Application Data

(63) Continuation-in-part of application No. 11/361,530, filed on Feb. 23, 2006, now Pat. No. 7,631,799, which is a continuation-in-part of application No. 11/102,965, filed on Apr. 11, 2005, now Pat. No. 7,699,212.

(60) Provisional application No. 60/561,497, filed on Apr. 13, 2004.

(51) Int. Cl.
*B65D 6/00* (2006.01)
*B65D 8/14* (2006.01)

(52) U.S. Cl. ..... 220/4.29; 220/6; 220/666

(58) Field of Classification Search ..... 220/4.08, 220/4.28, 4.29, 6, 666, 754, 766, 768, 769, 220/324; 217/12 R, 43 R, 38
See application file for complete search history.

(56) References Cited

U.S. PATENT DOCUMENTS

| | | | |
|---|---|---|---|
| 70,598 | A | 11/1867 | Morgan |
| 241,254 | A | 5/1881 | Udel |
| 680,186 | A | 8/1901 | Van Wormer |
| 734,449 | A | 7/1903 | Van Wormer |
| 798,264 | A | 8/1905 | Carrier |
| 886,462 | A | 5/1908 | Amos |
| 1,354,928 | A | 10/1920 | Watson |
| 1,855,045 | A | 4/1932 | Filmer |
| 1,906,174 | A | 4/1933 | Miller |
| 1,921,946 | A | 8/1933 | Rudowitz |
| 2,006,811 | A | 7/1935 | Mersbach |
| 2,067,998 | A | 1/1937 | Williamson |

(Continued)

FOREIGN PATENT DOCUMENTS

DE 44 18 666 3/1995

(Continued)

OTHER PUBLICATIONS

Web Page "Pactiv Air® Systems," at http:--pactiv.com-PactivAir-dated Sep. 18, 2004 (1 page).

(Continued)

*Primary Examiner* — Jacob K Ackun
*Assistant Examiner* — Kareen Rush

(57) ABSTRACT

A container includes a plurality of resilient wall panels. Each wall panel is connected to each adjacent wall panel at a hinged connection, and the wall panels are arranged so as to articulate at the hinged connections between a collapsed position and an expanded position defining a bottom wall and a plurality of side walls extending upwardly from the bottom wall and defining an upper lip. At least one of the hinged connections between adjacent side walls is an arched hinge. The container also includes a downwardly projecting bracket disposed proximate the upper lip on an exterior side of a side wall.

13 Claims, 16 Drawing Sheets

U.S. PATENT DOCUMENTS

| | | | | | |
|---|---|---|---|---|---|
| 2,859,905 | A | | 11/1958 | Choate | |
| 2,914,210 | A | | 11/1959 | Paston | |
| 3,015,412 | A | * | 1/1962 | Klages | 220/751 |
| 3,254,786 | A | | 6/1966 | Melville | |
| 3,319,684 | A | * | 5/1967 | Calhoun | 604/326 |
| 3,354,924 | A | * | 11/1967 | Birrell et al. | 220/666 |
| 3,369,727 | A | | 2/1968 | Wright | |
| 3,376,994 | A | | 4/1968 | Flinn, Jr. | |
| 3,424,365 | A | | 1/1969 | Venturi | |
| 3,445,052 | A | | 5/1969 | Lewallen | |
| 3,497,127 | A | | 2/1970 | Box | |
| 3,601,172 | A | * | 8/1971 | Bourquin | 220/4.28 |
| 3,635,361 | A | | 1/1972 | Hayes | |
| 3,638,835 | A | * | 2/1972 | Goodrich et al. | 222/107 |
| 3,655,114 | A | | 4/1972 | Turner | |
| 3,784,043 | A | * | 1/1974 | Presnick | 220/4.28 |
| 3,796,342 | A | | 3/1974 | Sanders et al. | |
| 3,858,745 | A | | 1/1975 | Cloyd | |
| 3,870,185 | A | | 3/1975 | Sanders et al. | |
| 3,955,703 | A | | 5/1976 | Zebarth | |
| 4,005,795 | A | | 2/1977 | Mikkelsen et al. | |
| 4,057,165 | A | | 11/1977 | Kardell | |
| 4,064,206 | A | | 12/1977 | Seufert | |
| 4,164,316 | A | | 8/1979 | Gooding | |
| 4,179,252 | A | | 12/1979 | Seufert | |
| 4,235,345 | A | | 11/1980 | Vandedrink et al. | |
| 4,235,346 | A | | 11/1980 | Liggett | |
| 4,252,266 | A | | 2/1981 | Kupersmit | |
| 4,405,077 | A | | 9/1983 | Kupersmit | |
| D285,906 | S | | 9/1986 | Tyler | |
| 4,678,095 | A | | 7/1987 | Barnett et al. | |
| 4,684,034 | A | * | 8/1987 | Ono et al. | 220/6 |
| 4,694,986 | A | | 9/1987 | Chou | |
| 4,700,862 | A | | 10/1987 | Carter et al. | |
| 4,717,524 | A | | 1/1988 | Aoki | |
| 4,722,473 | A | | 2/1988 | Sandrini et al. | |
| 4,746,059 | A | | 5/1988 | Jackson | |
| 4,757,909 | A | | 7/1988 | Matsuura | |
| 4,780,261 | A | | 10/1988 | Vajtay | |
| 4,781,300 | A | | 11/1988 | Long | |
| 4,790,714 | A | | 12/1988 | Schnapp | |
| 4,813,200 | A | | 3/1989 | Kirchner | |
| 4,819,824 | A | | 4/1989 | Longbottom et al. | |
| 4,826,039 | A | | 5/1989 | Landis | |
| 4,828,132 | A | | 5/1989 | Francis, Jr. et al. | |
| 4,872,586 | A | | 10/1989 | Landis | |
| 4,886,184 | A | | 12/1989 | Chamourian | |
| 4,917,254 | A | * | 4/1990 | Ciriacks | 220/666 |
| 4,930,644 | A | | 6/1990 | Robbins, III | |
| 4,938,413 | A | | 7/1990 | Wolfe | |
| 4,946,430 | A | | 8/1990 | Kohmann | |
| 4,948,039 | A | | 8/1990 | Amatangelo | |
| 4,953,735 | A | | 9/1990 | Tisbo et al. | |
| D318,015 | S | | 7/1991 | DeCoster et al. | |
| 5,042,713 | A | | 8/1991 | Stafford | |
| 5,048,707 | A | | 9/1991 | Hallberg | |
| 5,064,068 | A | | 11/1991 | Sheng | |
| 5,081,740 | A | | 1/1992 | Smith | |
| 5,183,672 | A | | 2/1993 | Fetterhoff et al. | |
| D336,613 | S | | 6/1993 | Zutler | |
| D336,850 | S | | 6/1993 | Guillin | |
| 5,230,689 | A | | 7/1993 | Derby | |
| 5,257,707 | A | * | 11/1993 | Soede | 220/4.29 |
| 5,268,138 | A | | 12/1993 | Fetterhoff et al. | |
| 5,275,300 | A | | 1/1994 | Johnson | |
| 5,292,242 | A | | 3/1994 | Robbins, III | |
| 5,299,704 | A | | 4/1994 | Thorby | |
| 5,300,748 | A | | 4/1994 | Colombo | |
| D354,436 | S | | 1/1995 | Krupa | |
| 5,384,138 | A | | 1/1995 | Robbins, III | |
| D358,936 | S | | 6/1995 | Wagaman, III | |
| 5,437,386 | A | | 8/1995 | Von Holdt | |
| 5,472,107 | A | | 12/1995 | Lieber | |
| D366,212 | S | | 1/1996 | Jones | |
| D366,830 | S | | 2/1996 | Christianson | |
| D367,609 | S | | 3/1996 | Frank et al. | |
| 5,501,758 | A | | 3/1996 | Nitardy | |
| 5,524,789 | A | * | 6/1996 | Jackman | 220/666 |
| 5,554,093 | A | | 9/1996 | Porchia et al. | |
| 5,555,989 | A | | 9/1996 | Moran, Jr. | |
| 5,575,398 | A | | 11/1996 | Robbins, III | |
| 5,622,276 | A | | 4/1997 | Simmons | |
| 5,632,401 | A | * | 5/1997 | Hurd | 220/495.07 |
| D387,272 | S | | 12/1997 | Lippincott | |
| 5,699,914 | A | | 12/1997 | Broersma | |
| 5,699,925 | A | | 12/1997 | Petruzzi | |
| 5,699,959 | A | | 12/1997 | Huspeka et al. | |
| 5,735,423 | A | | 4/1998 | Black | |
| 5,743,405 | A | | 4/1998 | Reid | |
| 5,746,871 | A | | 5/1998 | Walsh | |
| 5,762,262 | A | | 6/1998 | Martin | |
| 5,772,070 | A | | 6/1998 | Hayes et al. | |
| 5,772,110 | A | | 6/1998 | Garretson | |
| 5,785,179 | A | | 7/1998 | Buczwinski et al. | |
| 5,833,116 | A | | 11/1998 | Guillin | |
| 5,839,604 | A | | 11/1998 | Straussman | |
| 5,868,268 | A | | 2/1999 | Walker | |
| D409,484 | S | | 5/1999 | Tasker | |
| 5,918,743 | A | | 7/1999 | Uitz | |
| D415,680 | S | | 10/1999 | Sheffer | |
| 5,975,411 | A | | 11/1999 | Windolph, III | |
| 5,979,690 | A | | 11/1999 | Hartley | |
| 5,996,882 | A | | 12/1999 | Randall | |
| 6,006,918 | A | * | 12/1999 | Hart | 206/600 |
| D421,901 | S | | 3/2000 | Hill | |
| D421,902 | S | | 3/2000 | Hill | |
| 6,032,815 | A | * | 3/2000 | Elstone | 220/6 |
| 6,050,410 | A | | 4/2000 | Quiron | |
| 6,050,482 | A | | 4/2000 | Cai | |
| 6,056,138 | A | | 5/2000 | Chen | |
| D427,063 | S | | 6/2000 | May | |
| 6,092,687 | A | | 7/2000 | Hupp et al. | |
| 6,098,826 | A | * | 8/2000 | Kim | 220/4.02 |
| 6,098,827 | A | | 8/2000 | Overholt et al. | |
| 6,102,280 | A | | 8/2000 | Dowd | |
| 6,112,928 | A | | 9/2000 | Black et al. | |
| 6,116,501 | A | | 9/2000 | Hupp | |
| 6,126,065 | A | | 10/2000 | Wee | |
| 6,170,696 | B1 | | 1/2001 | Tucker et al. | |
| D437,686 | S | | 2/2001 | Balzar et al. | |
| 6,196,404 | B1 | | 3/2001 | Chen | |
| D442,081 | S | | 5/2001 | Paul | |
| 6,245,277 | B1 | | 6/2001 | Diamond | |
| 6,279,774 | B1 | | 8/2001 | Clute et al. | |
| 6,299,011 | B1 | * | 10/2001 | Rosenfeldt | 220/4.29 |
| 6,315,151 | B1 | * | 11/2001 | Hupp et al. | 220/666 |
| 6,325,239 | B2 | | 12/2001 | Randall et al. | |
| 6,386,437 | B1 | | 5/2002 | Larson, Jr. | |
| 6,401,968 | B1 | | 6/2002 | Huang et al. | |
| 6,405,888 | B1 | | 6/2002 | Overholt et al. | |
| 6,435,384 | B1 | | 8/2002 | Davis et al. | |
| 6,564,960 | B1 | | 5/2003 | Grindstaff et al. | |
| 6,585,129 | B2 | | 7/2003 | Moody et al. | |
| 6,609,633 | B1 | | 8/2003 | Dyble et al. | |
| 6,612,441 | B2 | | 9/2003 | Lang et al. | |
| 6,648,159 | B2 | | 11/2003 | Prutkin et al. | |
| 6,669,045 | B2 | | 12/2003 | Wang | |
| 6,682,686 | B1 | | 1/2004 | Iwasaki et al. | |
| D487,347 | S | | 3/2004 | Felsenthal | |
| 6,761,279 | B1 | | 7/2004 | Martin et al. | |
| D496,585 | S | | 9/2004 | McBride et al. | |
| 6,805,659 | B2 | | 10/2004 | Bohrer | |
| 6,976,602 | B1 | | 12/2005 | Maxwell | |
| 7,699,212 | B2 | * | 4/2010 | Turvey et al. | 229/117.02 |
| 2002/0179600 | A1 | | 12/2002 | King | |
| 2002/0189166 | A1 | | 12/2002 | Weder | |
| 2003/0010814 | A1 | | 1/2003 | Lorusso | |
| 2003/0052158 | A1 | * | 3/2003 | Spindel et al. | 229/122.21 |
| 2003/0168452 | A1 | | 9/2003 | Prutkin et al. | |
| 2004/0069780 | A1 | | 4/2004 | Apps et al. | |
| 2004/0155037 | A1 | | 8/2004 | Hoogland | |
| 2004/0164132 | A1 | | 8/2004 | Kuester | |
| 2005/0017000 | A1 | * | 1/2005 | Vergiels et al. | 220/4.28 |
| 2005/0035186 | A1 | | 2/2005 | Casalotto | |
| 2005/0061859 | A1 | | 3/2005 | Hennessy | |
| 2005/0224563 | A1 | * | 10/2005 | Turvey et al. | 229/117.02 |
| 2005/0230390 | A1 | | 10/2005 | Glenn | |

| | | | | |
|---|---|---|---|---|
| 2006/0191929 | A1 | 8/2006 | Berg, Jr. et al. | |
| 2006/0191985 | A1 | 8/2006 | Norcom | |
| 2006/0193541 | A1 | 8/2006 | Norcom | |
| 2007/0007289 | A1 | 1/2007 | Hoberman | |
| 2007/0045311 | A1 | 3/2007 | Wang | |
| 2007/0241173 | A1* | 10/2007 | Turvey et al. | 229/117.03 |
| 2007/0241174 | A1* | 10/2007 | Turvey et al. | 229/117.03 |
| 2007/0246519 | A1* | 10/2007 | Turvey et al. | 229/117.01 |

FOREIGN PATENT DOCUMENTS

| | | | |
|---|---|---|---|
| EP | 76624 | A1 | 4/1983 |
| GB | 1 580 996 | | 12/1980 |
| GB | 2 367 283 | | 4/2002 |

OTHER PUBLICATIONS

Web Page "Hefty Express®," at http:--www.pactiv.com-Heftyexpress-indexmailers.asp dated Sep. 18, 2004 (1 page).
Web Page "Hefty® Slide-Rite® Closure Solutions," at http:--pactiv.com-sliderite- dated Sep. 18, 2004 (1 page).
Web Page "Hinged Lid Containers," at http:--pactivpartners.pactiv.com-productcatalog-Rooms-DisplayPages-LayoutInitial?Contai... dated Sep. 18, 2004 (1 page).
Web Page "Paperboard Hinged Take-Out Containers," at http:--pactivpartners.pactiv.com-productcatalog-Rooms-DisplayPages-LayoutInitial?Contai... dated Sep. 18, 2004 (1 page).
Web Page "Kitchen Seal n Saver Containers," at http:--www.rubbermaid.com-hpd-consumer-product-list.jhtml dated Sep. 18, 2004 (1 page).
Web Page "Stuffables™ Storage Containers," at http:--order.tupperware.com-ls-htprod_www-tup_show_item.show_item_detail dated Sep. 18, 2004 (1 page).
Web Page "FlatOut! Containers," at http:--i13.ebayimg.com-03-i-02-4a-c6-bb_1_b.JPG dated Sep. 18, 2004 (1 page).
Web Page "SmartCrate™," at http:--www.ipl-mh.com-returnable_containers.asp dated Sep. 20, 2004 (1 page).
Web Page "Techno Bin," at http:--www.techcontainer.com-bulkbins.html dated Sep. 20, 2004 (1 page).
Web Page "ComboFructus," at http:--www.packagingnetwork.com-content-productshowcase-prodct.asp?docid= 140155e... dated Sep. 19, 2004 (1 page).
Web Page "The Repak Insulated Pallet Shipper," at http:--www.packagingnetwork.com-content-productshowcase-product.asp?docid=03b28f71... dated Sep. 19, 2004 (1 page).
Web Page Heavy Duty Collapsible Bin Box, 48"x 40" at http:--www.cisco-eagle.com-miva-merchant.mv?Screen=PROD&Store_Code=CEI&Produ... dated Sep. 18, 2004 (1 page).
Web Page "Xytec Gemini," at http:--www.packagingnetwork.com-content-productshowcase-product.asp?docid=1401552... dated Sep. 19, 2004 (1 page).
Web Page "Melog™ Collapsible Hand-Held Container," at http:--www.packagingnetwork.com-content-productshowcase-product.asp?docid=7d478a0... dated Sep. 19, 2004 (1 page).
Web Page "Collapsible Plastic Tote Bin," at http:--www.packagingnetwork.com-content-productshowcase-product.asp?docid=6e4bc74... dated Sep. 19, 2004 (1 page).
Web Page "Packaging Network: Digital Marketplace for the Packaging Industry," at http:--www.packagingnetwork.com-Catalgo2-CatalogBrowse.asp?CatID=RehrigPacific&B... dated Sep. 19, 2004 (1 page).
Web Page "IPL SmartCrate for Eggs," at http:--www.packagingnetwork.com-content-productshowcase-product.asp?docid=4f27cf19... dated Sep. 19, 2004 (1 page).
Web Page "Folding Crate," at http:--www.containerstore.com-browse-Product.jhtml?PRODID=60192&CATID=239 dated Sep. 19, 2004 (1 page).
Web Page "Rubbermaid Collapsible Crate," at http:--www.amazon.com-exec-obidos-tg-detail---B00019JP92-ref=k_de_a_smp-104-28421... dated Sep. 18, 2004 (1 page).
Web Page "Plastic Collapsible Containers," at http:--www.cherrysind.com-ci-palletscontainers-plastic-collapsible-container.shtml dated Sep. 18, 2004 (6 pages).
Web Page "Storage Boxes Graphite," at http:--www.containerstore.com-browse-Product.jhtml?PRODID=59856&CATID=71230 dated Sep. 19, 2004 (1 page).
Web Page "Collapsible, Reusable Carton," at http:--www.packagingnetwork.com-contentproductshowcase-product.asp?docid=5282cfa8... dated Sep. 19, 2004 (1 page).
Web Page "Returnable, Reusable, Collapsible Containers," at http:--www.packagingnetwork.com-content-productshowcase-product.asp?doci=ca4cc9a0... dated Sep. 19, 2004 (1 page).
Web Page "Black Wave Flute Gift Boxes," at http:--www.containerstore.com-browse-Product.jhtml?PRODID=62644&CATID=262 dated Sep. 19, 2004 (1 page).
Web Page "Collapsible Container—Magic," at http:--www.magicgoods.com-CollapContM.htm dated Sep. 18, 2004 (1 page).
Web Page "Blue Folding Mesh Cubes," at http:--www.containerstore.com-browse-Product.jhtml?PRODID=72108&CATID=166 dated Sep. 19, 2004 (1 page).
Web Page "Professional's Choice Collapsible Trash and Laundry Container," at http:--www.statelinetack.com-global-product_large_img.jsp?PRODUCT◇ord_ud=745524... dated Sep. 18, 2004 (1 page).
Web Page "Exotainer," at http:--www.packagingnetwork.com-content-productshowcase-product.asp?docid=c4e6fa99... dated Sep. 19, 2004 (1 page).
Web Page "Drake Stand-Up Decoy Bags," at http:--www.cabelas.com-cabelas-en-templates-productstandard-item.jhtml?id=0027683226... dated Sep. 19, 2004 (1 page).
Web Page "NRS Big Basin Water Container," at http:--www.nrsweb.com-shop-product.asp?pfid=2051&src=froogle&refer=2051 dated Sep. 18, 2004 (1 page).
Web Page "Double Folding Mesh Cube," at http:--www.thecontainerstore.com-browse-Product.jhtml?CATID=166&PRODID=69699&... dated Sep. 17, 2004 (1 page).
Web Page "Making Memories® Crop Can Black Mesh," at http:--www.createforless.com-products-productDetail.asp?ProductID=76177&GC1D=C106... dated Sep. 18, 2004 (1 page).
Web Page "Water Storage Collapsible Water Containers," at http:--lowprice4u.com-shoppingcart-ProductTemplate.ASP?Product-TemplateID=21078&F... dated Sep. 18, 2004 (1 page).
Web Page "Collapsible Fold-A-Jug Water Container," at http:--www.preparedness.com-colfolwatcon.html dated Sep. 18, 2004 (1 page).
Web Page "Crunch Cans," at http:--www.containerstore.com-browse-Product.jhtml?PRODID=62672&CATID=223 dated Sep. 19, 2004 (1 page).
Web Page "Corner Crunch Canvas Hamper," at http:--www.organizes-it.com-pocornercrunch.php dated Sep. 19, 2004 (1 page).
Web Page "Crunch Oval Laundry Basket," at http:--www.organizes-it.com-poovalcrunch.php dated Sep. 19, 2004 (1 page).
Web Page "Outcast Cooler Bags," at http:--www.cabelas.com-cabelas-en-templates-product-standard-item.jhtml?id=0018142316... dated Sep. 19, 2004 (1 page).
Web Page "Collapsible Storage Organizer," at http:--www.coleman.com-coleman-colemancom-detail.asp?product_id=816-100&categoryi... dated Sep. 19, 2004 (1 page).
Web Page "Artic Zone Ultimate 6 Can Collapsible Cooler New w-Tag," at http:--cgi.ebay.com-ws-eBayISAPI.d11?ViewItem&category=11703&item=4308355535&r... dated Sep. 18, 2004 (1 page).
Web Page "Collapsible Insulated Lunch Bag Cooler," at http:--cgi.ebay.com-ws-eBayISAPI.d11?ViewItem&category=11703&item=4324976900&r... dated Sep. 18, 2004 (1 page).
Web Page "Cubitainer-5 Gallon," at http:--www.thegrape.net-browse.cfm-4,9380.html dated Sep. 18, 2004 (1 page).
Web Page "Collapsible Water Jug Container, 5 Gallon," http:--www.gr8gear.com-index.asp?PageAction=VIEWPROD&ProdID=2948 dated Sep. 18, 2004 (1 page).
Catalog Page from Cole-Parmer "Collapsible Container, LDPE," (p. 850).
Web Page "Lewis N. Clark Travel Cup with Pill Container," at http:--www.rei.com-online-store-ProductDisplay?productId=47780043&storied=8000&cat... dated Sep. 18, 2004 (1 page).

Web Page "Fold 'n Hold," at http:--www.inventorsstudio.com-FoldnHold.html dated Apr. 8, 2004 (2 pages) and Product Packaging Photocopies (4 pages).
Picture of "Collapsible Cubes," by Whitmor.
Hoberman Transformable Design: Architecture, "Storage", http://www.hoberman.com/site/storage/storage.html, 1 page, Printed Jan. 23, 2007.
Hoberman Transformable Design: Architecture, "Future", http://www.hoberman.com/site/future/future.html, 1 page, Printed Jan. 23, 2007.
Hoberman Transformable Design: Who We Are, http://www.hoberman.com/site/who__we__are/history.html, 2 pages, Printed Jan. 23, 2007.
Columbia Magazine, "The Future Tents", http://www.columbia.edu/cu/alumni/Magazine/Spring2006/hoberman.., 8 pages, Printed Jan. 23, 2007.
International Search Report and Written Opinion in PCT/US2005/012430 dated Oct. 7, 2005.
U.S. Appl. No. 11/361,530, Office Action dated Feb. 20, 2009.

* cited by examiner

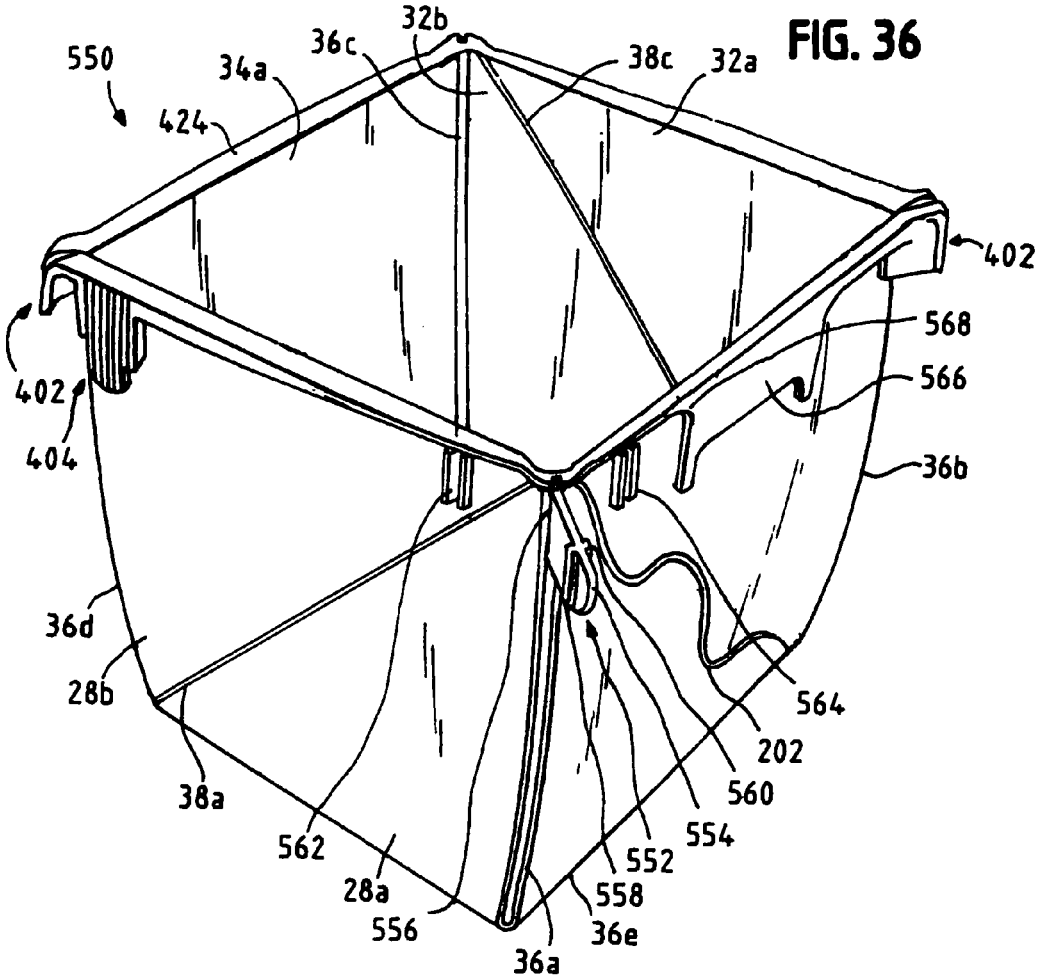
FIG. 36
FIG. 37
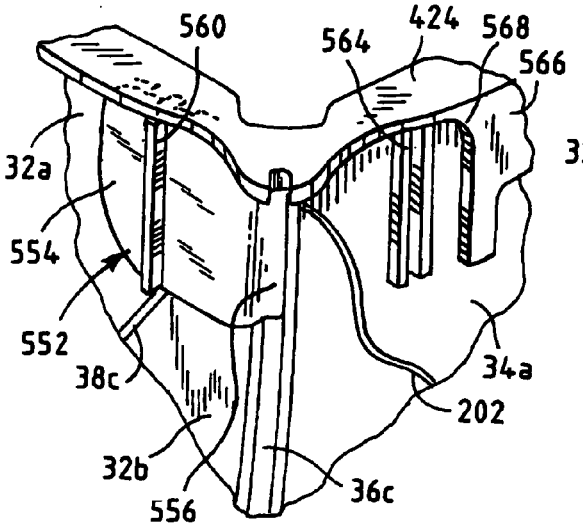
FIG. 38
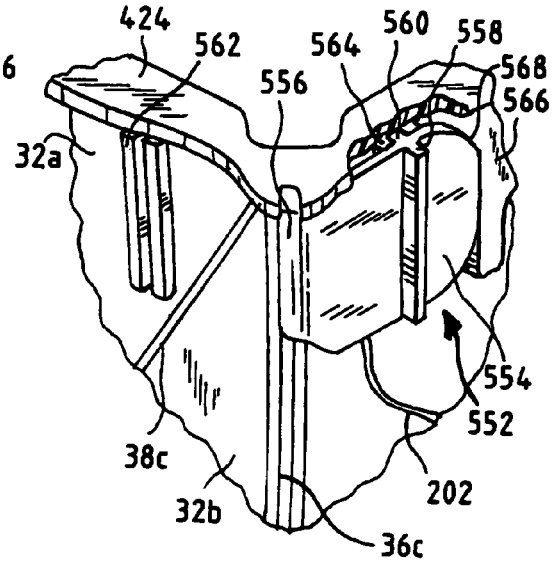

COLLAPSIBLE STORAGE DEVICE

CROSS REFERENCE TO RELATED APPLICATIONS

This application is a continuation-in-part of U.S. patent application Ser. No. 11/361,530, filed Feb. 23, 2006, now U.S. Pat. No. 7,631,799, which is a continuation-in-part of U.S. patent application Ser. No. 11/102,965, filed Apr. 11, 2005, now U.S. Pat. No. 7,699,212, which claims the benefit of U.S. Provisional Patent Application No. 60/561,497, filed Apr. 13, 2004. Each of the aforesaid applications is hereby incorporated by reference herein in its entirety.

REFERENCE REGARDING FEDERALLY SPONSORED RESEARCH OR DEVELOPMENT

Not applicable.

SEQUENTIAL LISTING

Not applicable.

BACKGROUND OF THE INVENTION

1. Technical Field

The present invention is directed toward a device for storing objects, and more particularly a collapsible storage device.

2. Background Art

It is sometimes desirable to have a storage device that is convertible between an expanded position and a collapsed position. In the expanded position, the storage device is capable of retaining objects within an interior space. In the collapsed position, the storage device has less or even no storage capability but is more convenient to store because it takes up less space.

A collapsible metal box container has a bottom, four sides, and a lid. The bottom and four sides are connected to each other with pin and knuckle hinges. The lid is connected to one of the sides with pin and knuckle hinges. Each of the bottom and two opposing sides is divided into a pair of opposing triangular segments that are connected to each other with pin and knuckle hinges. The box can be folded or unfolded between an expanded box shape and a substantially flat or planar collapsed shape.

A collapsible pasteboard box has a rectangular side wall extending upwardly from each of four peripheral edges of a square bottom wall. Each side wall is articulably connected to each adjacent side wall along one of four linear vertical hinges and is connected to the bottom wall along one of four horizontal hinges. A diagonal hinge in the bottom wall extends from one corner to an opposite corner. A diagonal hinge in each of two opposing side walls extends from a lower corner of the side wall along the bottom wall to an end point along the upper edge of the side wall displaced from an upper corner. The box folds along the hinges between a flat collapsed position and a cubic or rectangular prismatic expanded position. The box has the same footprint outline in both the collapsed position and the expanded position so that a lid accepts the box in both such positions.

Another collapsible paperboard box has a base portion and a lid portion. The base portion has a square bottom wall and four outwardly slanted side walls. Each side wall is articulably connected to each adjacent side wall along one of four outwardly slanted linear hinges and is connected to the bottom wall along one of four horizontal hinges. Two opposing side walls are divided into three generally triangular sections by two converging fold lines extending diagonally from each bottom corner toward a central location along a top edge thereof. The lid portion is articulably attached to a top edge of a third one of the side walls along a horizontal hinge. The base portion folds flat along the hinges and the fold lines, and the lid also has a rim portion that folds flat.

Another collapsible cardboard container has a square bottom, four rectangular side walls extending upwardly from the bottom, and an opening opposite the bottom. A removable lid is provided to cover the opening with a peripheral flange fitting about the side walls. Each side wall is separated into three sections, and at least one of the sections of each of the four side walls is divided into a pair of hingedly connected opposing triangular segments. The container is folded between a collapsed position and an expanded position by twisting the side walls to either fold or unfold the triangular segments.

Generally such metal and paperboard containers are not able to contain fluids without leaking without the addition of some sort of flexible liner or inner leak proof container. However, a flexible liner may be apt to tear and leak, and an inner container may be inconvenient and/or minimize or eliminate the benefit of the space saving purpose of a collapsible container. To overcome these challenges, some collapsible containers have been made of injection molded thermoplastics with living hinges articulably connecting some adjacent resilient panels. However, an inherent difficulty with injection molded living hinge members, called plastic memory, has made it difficult to make a collapsible container that will remain in the desired collapsed and/or expanded position. Because of plastic memory, the living hinges have a tendency to return to a relaxed position that is different from the desired expanded or collapsed position.

SUMMARY OF THE INVENTION

In one embodiment, a container includes a plurality of resilient wall panels. Each wall panel is connected to each adjacent wall panel at a hinged connection, and the wall panels are arranged so as to articulate at the hinged connections between a collapsed position and an expanded position defining a bottom wall and a plurality of side walls extending upwardly from the bottom wall and defining an upper lip. At least one of the hinged connections between adjacent side walls is an arched hinge. The container also includes a downwardly projecting bracket disposed proximate the upper lip on an exterior side of a side wall.

In another embodiment, a lid for a container includes a body that is adapted to cover an opening in a container, wherein the container includes a plurality of wall panels that define an upper lip, and wherein the upper lip further defines the opening. The lid also includes a peripheral groove disposed in a side of the body, wherein the groove is configured to receive the upper lip of the container. In addition, the lid includes a latch connected to a side of the body at a hinge, and the latch is articulable about the hinge between a first position and a second position. A distal portion of the latch is adapted to secure against an exterior side of the peripheral groove in the first position and the latch includes a finger that extends from a side of the latch that is adapted to engage a bracket on the container in the second position.

In yet another embodiment, a storage device includes a container that has a plurality of wall panels. Each wall panel is connected to each adjacent wall panel at a hinged connection, and the wall panels are arranged so as to articulate at the hinged connections between a collapsed position and an expanded position that defines an upper lip. The upper lip further defines an opening. The container also includes a bracket disposed proximate the upper lip of the container on an exterior side of a side wall. The bracket is spaced from the side wall. The storage device further includes a lid that has a body adapted to cover the opening and a latch connected to a side of the body at a hinge. The latch is articulable about the hinge between a first position and a second position. A distal portion of the latch is adapted to secure against an exterior side of the body in the first position and the latch is adapted to engage the bracket in the second position.

These and other aspects and advantages of the present invention will become apparent upon consideration of the following detailed description in which;

BRIEF DESCRIPTION OF THE DRAWINGS

FIG. 36 is an isometric view of a collapsible container according to yet a further embodiment in a fully expanded position;

FIG. 37 is an enlarged partial isometric view of an anti-fold lock on the collapsible container of FIG. 36 in a first position; and FIG. 38 is an enlarged partial isometric view of the anti-fold lock of FIG. 37 in a second position.

DETAILED DESCRIPTION

Figure 1:
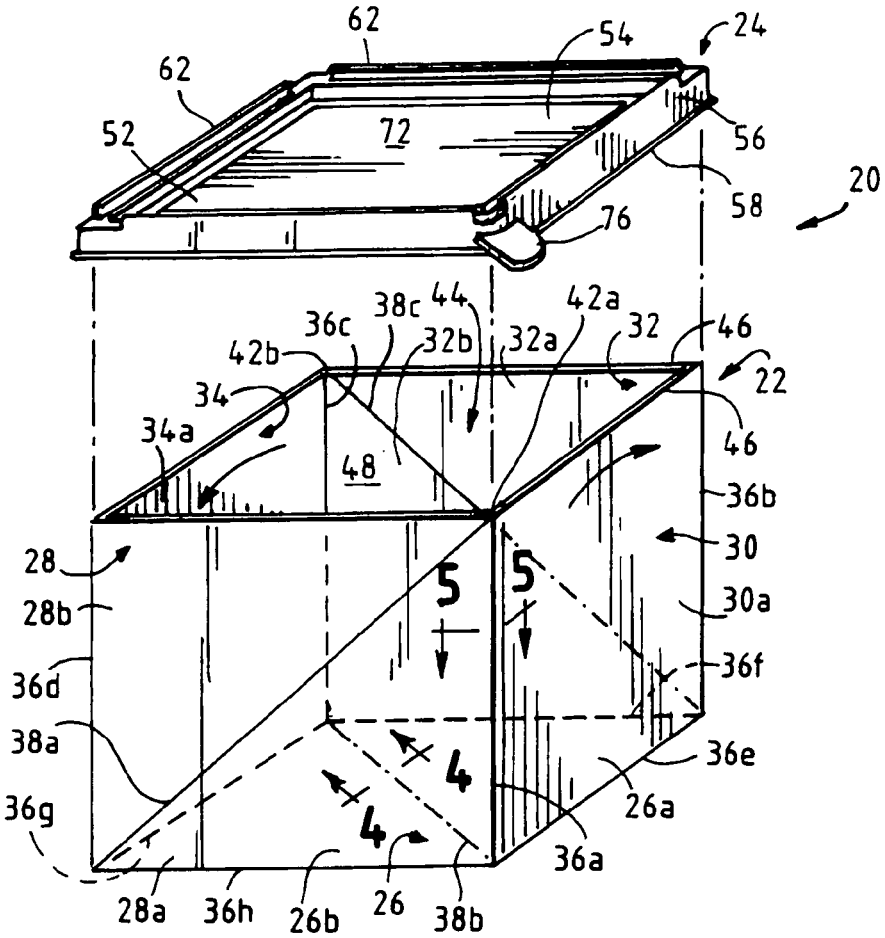
FIG. 1 is an isometric view of a collapsible storage device according to one embodiment of the invention with a lid over an opening of a collapsible container in an expanded position.
Figure 2:
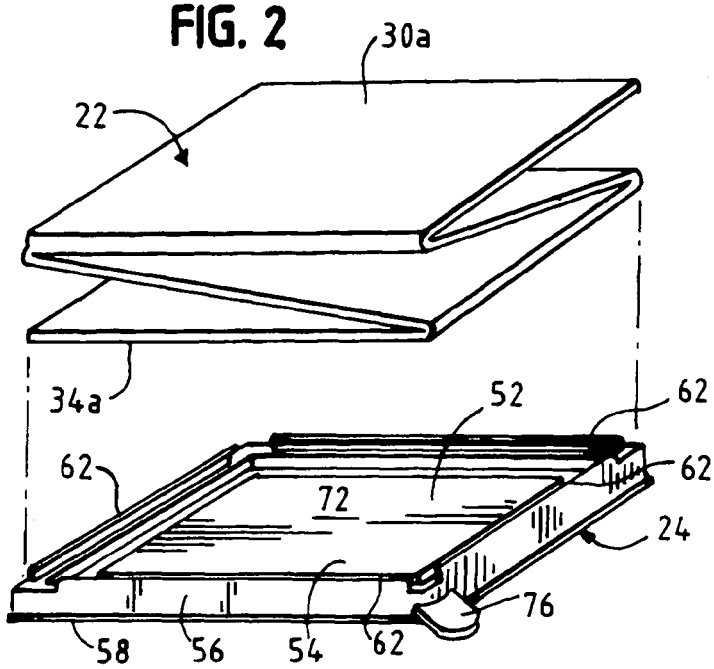
FIG. 2 is an isometric view of the storage device of FIG. 1 with the collapsible container in a collapsed position and ready to be placed in a recessed portion of the lid.
Figure 3:
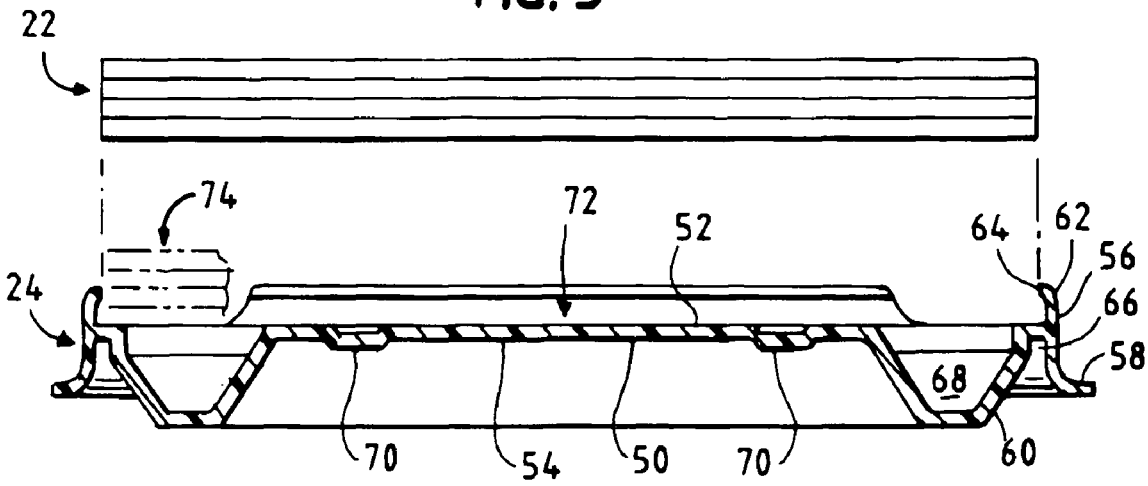
FIG. 3 is a vertical cross-sectional view of the storage device of FIG. 2 with the collapsed collapsible container partly shown fitted into the recessed portion of the lid.

Referring now to FIGS. 1-3, a single unit storage device 20 according to the present invention includes a collapsible container 22 and a lid 24. The container 22 includes resilient wall panels connected by flexible hinges that are convertible between an expanded position as shown in FIG. 1 and a collapsed position as shown in FIG. 2. The container 22 and lid 24 in one embodiment are made of a thermoplastic, such as polypropylene, polyethylene, or other polyolefin, nylon, or other resilient polymeric material. In another embodiment, the container 22 and the lid 24 are made of organic or biodegradable polymers, such as polyesters based on lactic acid (for example, PLA). The container 22 includes a bottom wall 26 and four side walls 28, 30, 32, and 34 extending upwardly from the outer periphery of the bottom wall. Each of the bottom wall 26 and the side walls 28, 30, 32, and 34 is substantially square in shape, although one or more of the walls may have a different shape. Each of the bottom wall 26 and the side walls 28 and 32 includes a pair of complimentary triangular panels 26*a*, 26*b*, 28*a*, 28*b*, and 32*a*, 32*b*, respectively, wherein the panels of each pair are hingedly joined to form the respective wall. Each of the side walls 30 and 34 comprises a single panel 30*a* and 34*a*, respectively. Each panel 26*a*, 26*b*, 28*a*, 28*b*, 30*a*, 32*a*, 32*b*, and 34*a* is connected to adjacent panels by one of living hinges 36*a*, 36*b*, 36*c*, 36*d*, 36*e*, 36*f*, 36*g*, 36*h*, 38*a*, 38*b*, and 38*c* such that the container 22 may be converted from the expanded position of FIG. 1 to the substantially flat collapsed position of FIG. 2. This conversion is accomplished by moving the panel 30 and the panel 34 in opposite directions (as seen in FIG. 1) so that corners 42*a* and 42*b* converge toward one another. Continued opposite movement of the panels 30*a* and 34*a* results in rotation of the panel 30*a* clockwise and rotation of the panel 34*a* counterclockwise (as seen in FIG. 1) 90° with respect to each other, during which time the panels 26*a* and 26*b*, 28*a* and 28*b*, and 32*a* and 32*b* collapse inwardly toward one another in a folding motion about the hinges 38*b*, 38*a*, and 38*c*, respectively. This collapsing is afforded by movement of the panels 26*a*, 26*b*, 28*a*, 28*b*, 30*a*, 32*a*, 32*b*, and 34*a* about the living hinges 36*a-h* and 38*a-c*. Eventually, the panels 26*a*, 26*b*, 28*a*, 28*b*, 30*a*, 32*a*, 32*b*, and 34*a* collapse into the configuration shown in FIG. 2. The collapsed container 22 may be expanded by reversing the process. Another method of converting the container 22 to the collapsed position is to push bottom hinge 38*b* upwardly and hinges 38*a* and 38*b* inwardly, which causes the same folding/collapsing motion of the panels 26*a,b*; 28*a,b*; and 32*a,b*, as described.

In the expanded position, the bottom wall 26 and side walls 28, 30, 32, and 34 of the container 22 define an interior space 44, and upper edges 46 of the side walls 28, 30, 32, and 34 define an opening 48 into the interior space. The interior space 44 of the expanded container 22 may be filled through opening 48 with a product (not shown). The force of the product contained within the interior space 44 pressing outwardly against the side walls 28, 30, 32, and 34 and bottom wall 26, and hinges 38*a-c* assists in maintaining the container 22 in the expanded position by preventing the panels 26*a,b*, 28*a,b*, and 32*a,b* from collapsing inwardly, and in another embodiment, one or more latching mechanisms are used to maintain the container in the expanded position. The lid 24 is adapted to cover the opening 48 to completely enclose the interior space 44.

The lid 24 has an interior, or product side 50 and an exterior, or stacking side 52 opposite the product side. The lid 24 includes a cover plate 54, a peripheral flange 56 with an outwardly-flared skirt 58, a tapered lead-in 60, and a retaining wall 62 with an inwardly-turned lip 64 along the upper edge of the retaining wall. The flange 56 and lead-in 60 define a groove 66 extending around the outer periphery of the cover plate 54 on the product side 50 of the lid 24. The cover plate 54 is adapted to cover the opening 48 of the container 22 when the container is in the expanded position with the upper edge 46 of the side walls 28, 30, 32, and 34 fitting into the peripheral groove 66 of the lid 24 so that the product side 50 is facing any product contained in the interior space 44. The tapered lead-in 60 and flared skirt 58 help guide the upper edge 46 of the side walls 28, 30, 32, and 34 into the groove 66 as the lid 24 is being placed over the opening 48. The lead-in 60 extends below the flared skirt 58 with a gentle enough taper to readily catch the side walls 28, 30, 32, and 34 and urge them outwardly if they are bowed inwardly. For this purpose, the lead-in 60 is preferably tapered inwardly and toward the center of the lid 24 from the groove 66 a distance greater than any anticipated inward bowing of the side walls 28, 30, 32, and 34. The lead-in 60 is preferably formed by the opposite side of a recessed channel 68 in the cover plate 54 inwardly spaced from the outer periphery of the cover plate; however, any form of tapered lead-in structure could be used. In one embodiment, the recessed channel 68 extends continuously around the cover plate 54, and in another embodiment, the recessed channel extends intermittently around the cover plate. Structural and aesthetic relief indentations 70 in the cover plate 54 provide added structural integrity and aesthetic design to the lid 24. The retaining walls 62 protrude upwardly from and extend intermittently around the cover plate 54 to form a recess 72 on the stacking side 52 of the lid 24. The recess 72 is adapted to receive the container 22 in either the collapsed position or the expanded position so that the container can be stacked onto the stacking side 52 of the lid 24. The container 22 lies substantially flat within the recess 72 when in the collapsed position as partially depicted in dashed lines at 74 in FIG. 3. The lip 64 presses resiliently against the edges of at least one of the side walls 28, 30, 32, and 34 of the collapsed container 22 that is fitted within the recess 72 to releasably restrain the container within the recess by means of a snap-fit. A thumb tab 76 extending outwardly from the flange 56 provides a convenient mechanism for prying the lid 24 away from the container 22, both when the container is stacked within the recess 72, and when the lid is covering the opening 48.

Figure 4:
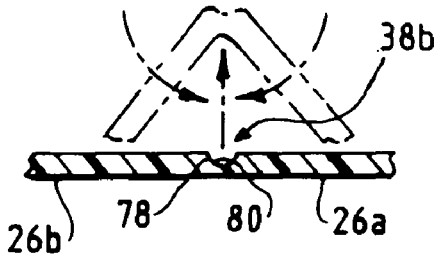
FIG. 4 is a fragmentary cross-sectional view taken generally along the lines 4-4 of FIG. 1.
Figure 5:
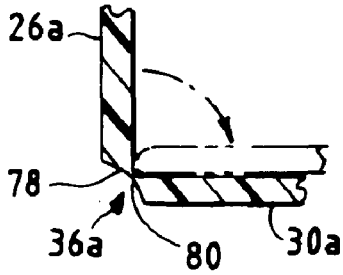
FIG. 5 is a fragmentary cross-sectional view taken generally along the lines 5-5 of FIG. 1.

Referring now to FIGS. 4 and 5, each living hinge 36*a-h* and 38*a-c* according to one embodiment of the present invention includes a notch 78 and a flexible hinge portion 80 as best seen in FIG. 4. The hinge portion 80 is slightly off center from the panel axis, which provides a measure of directionality to the hinge, and which conveniently lends itself to describing the hinges in the container 22 as being either interior hinges or exterior hinges. An interior hinge is a living hinge in which the hinge portion 80 is offset toward the interior space 44 of the expanded container 22. An exterior hinge is a living hinge in which the hinge portion 80 is offset away from the interior space 44 of the expanded container 22. Hinges 36*a-h* are interior hinges, and hinges 38*a-c* are exterior hinges. This placement of interior and exterior living hinges allows the hinge portion 80 of each of the hinges 36*a-h* and 38*a-c* to be rotated away from the notch 78 when converting the container 22 from the expanded position to the collapsed position as shown in FIGS. 4 and 5, which minimizes any interference between the panels on opposite sides of the hinge portion as those panels are rotated about the hinge portion. In another embodiment, any or all of the hinges may be formed by fold lines that are defined in the walls of the container 22 by other methods.

Figure 6:
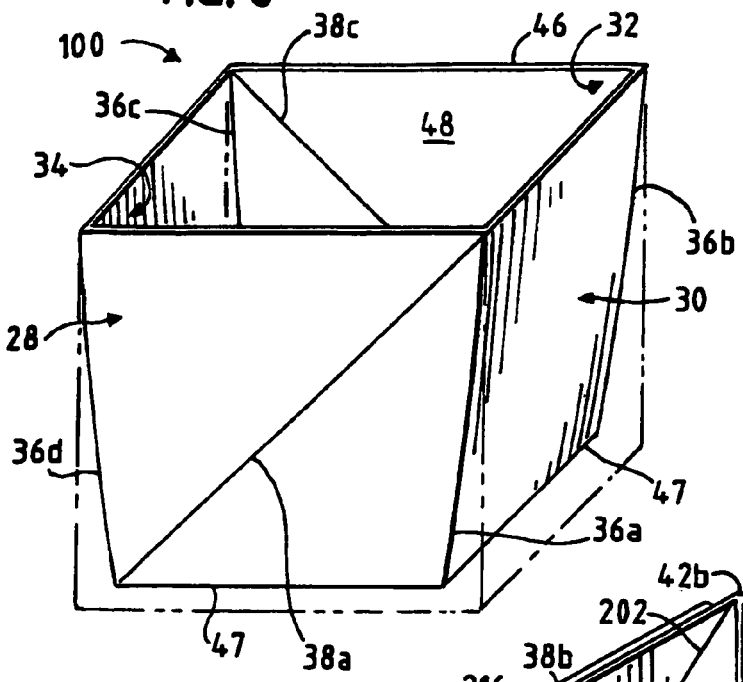
FIG. 6 is an isometric view of an embodiment of a collapsible container having arched living hinges.
Figure 7:
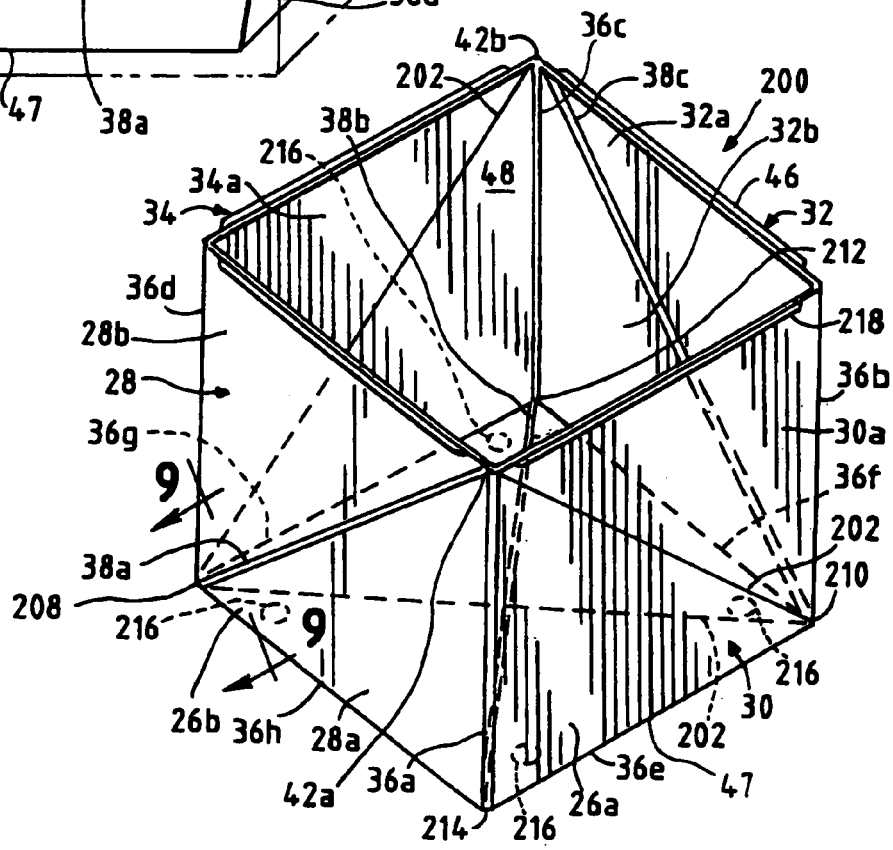
FIG. 7 is an isometric view of yet another embodiment of a collapsible container.

In an embodiment shown in FIG. 6, a collapsible container 100 has a fold geometry similar to the collapsible container 22 and has arched living hinges. Each vertical corner hinge 36*a*, 36*b*, 36*c*, and 36*d* is an out-of-plane arched hinge. The bottom wall 26 (not shown) and opening 48 are generally square, and each side wall 28, 30, 32, and 34 has a straight upper edge 46 and straight bottom edge 47. In this embodiment, the opening 48 is larger than the bottom wall 26 so that the arched vertical corner hinges 36*a-d* are always inside a vertical projection of the opening 48 in order to facilitate easy ejection of the container 100 from a non-segmented mold. In another embodiment, the opening 48 is the same size as the bottom wall 26, and the arched vertical hinges 36*a-d* bow outwardly of the vertical projection of the opening. Other embodiments may have different combinations of arched hinges such as: having all of the hinges be out-of-plane arched hinges, having at least one of the hinges be an out-of-plane arched hinge with the remaining hinges being straight hinges, having at least one in-plane arched hinge and at least one straight hinge, and having a combination of in-plane arched hinges, out-of-plane arched hinges, and straight hinges. In another embodiment according to the present invention, the diagonal hinges 38*a-c* are in-plane arched hinges, and in another embodiment, the diagonal hinges 38*a-c* are out-of-plane arched hinges. In any embodiment including arched living hinges, the amount of non-linearity between the ends of the hinge may be sufficient to cause the arched hinges to be bi-modal, having a stressed mode when the hinges are folded and an unstressed mode when the hinges are not folded. The arched hinges may be formed by an edge having a single arcuate segment, by an edge having a plurality of distinct arcuate or linear segments, and/or by other non-linear shapes.

Figure 8:
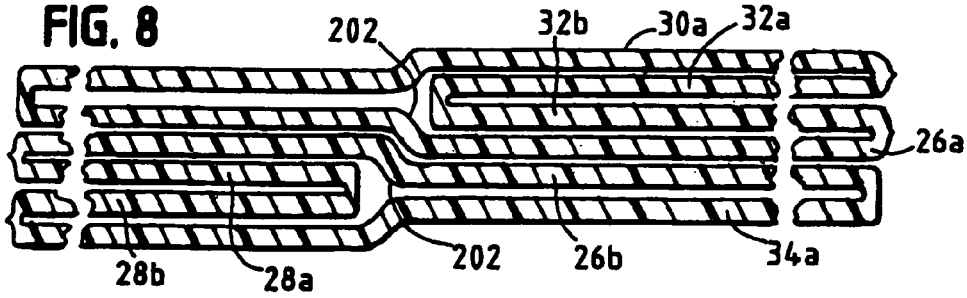
FIG. 8 is a partial cross-sectional view of the collapsible container of FIG. 7 in a collapsed position.
Figure 9:
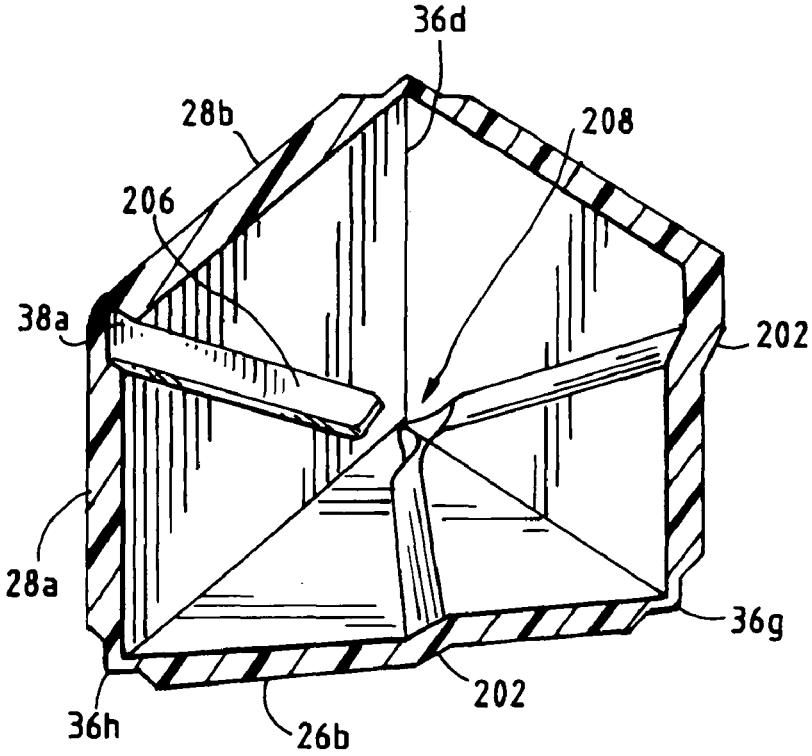
FIG. 9 is an enlarged isometric inside view in partial cross section of a single thickness corner of the collapsible container of FIG. 7.
Figure 10:
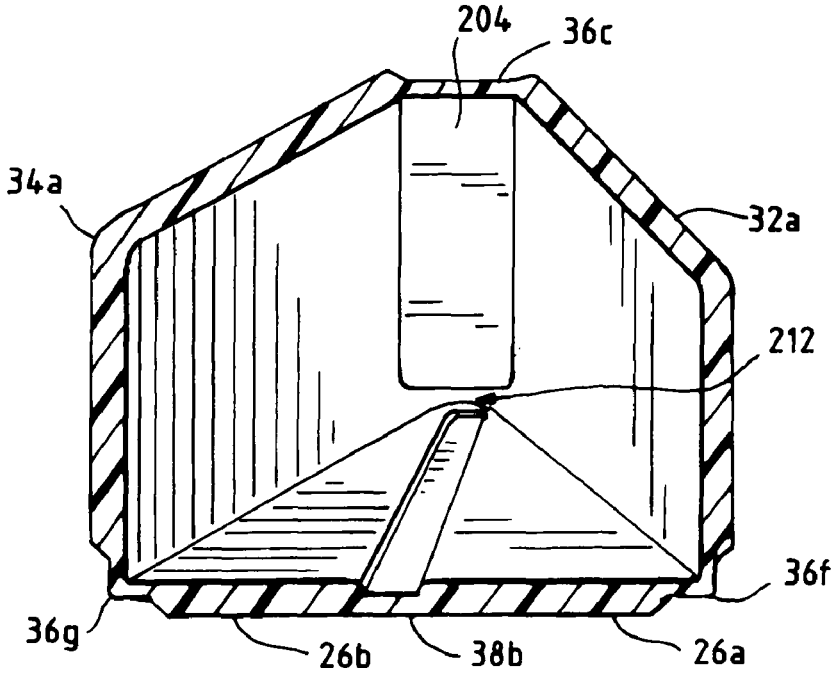
FIG. 10 is an enlarged isometric inside view in partial cross section of a double thickness corner of the collapsible container of FIG. 7.
Figure 11:
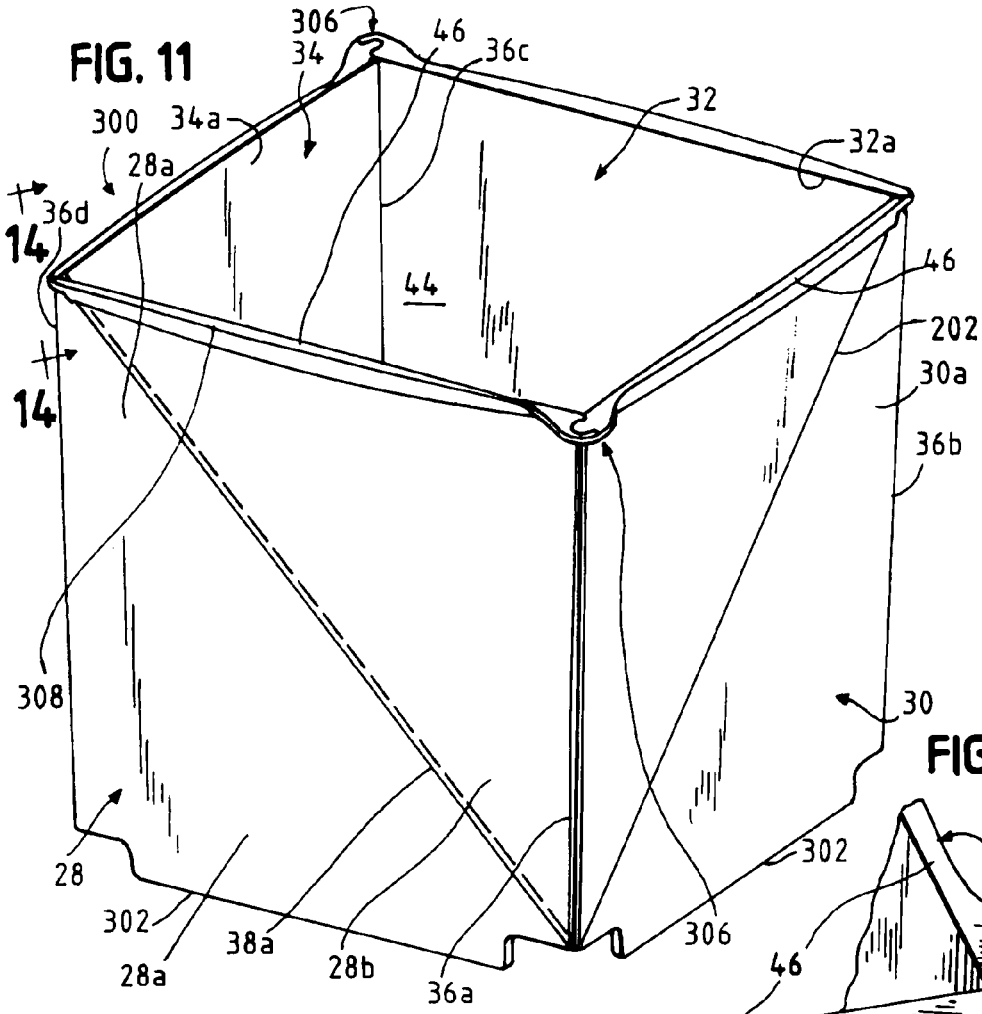
FIG. 11 is an isometric view of a collapsible container according to a further embodiment of the invention.
Figure 13:
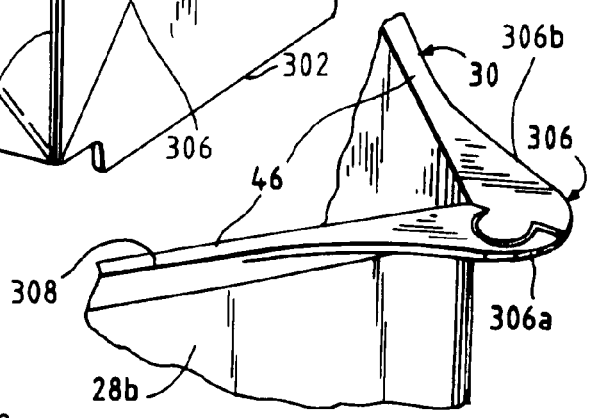
FIG. 13 is an enlarged partial isometric view of an interlocking mechanism on the collapsible container of FIG. 11.
Figure 12:
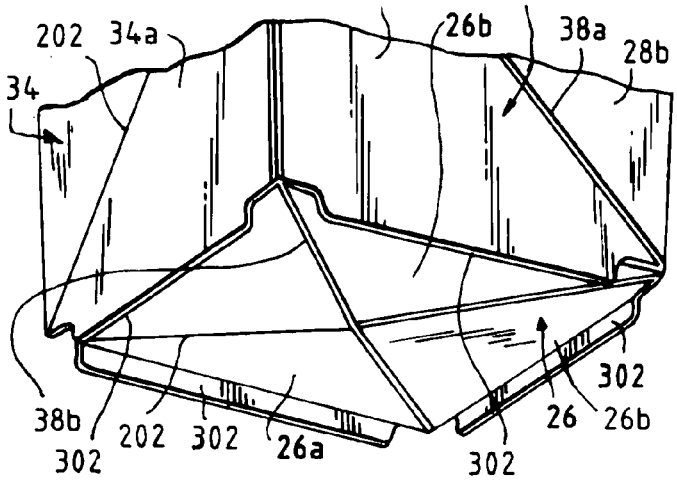
FIG. 12 is a partial isometric view of a bottom side of the collapsible container of FIG. 11.

In yet another embodiment of the present invention shown in FIGS. 7-10, a leak resistant plastic container 200 that is injection molded as a single piece from polyethylene has the same fold geometry as the container 22 and includes three-dimensional side wall panels and variable width hinges. As best seen in FIGS. 8-10, each of the side walls 26, 30, and 34 includes a diagonal offset, or step 202, located at transition points between a two-layered thickness of panels and a four-layered thickness of wall panels when the container is in the collapsed position. Each of the vertical corner hinges 36*a* and 36*c* (best seen in FIG. 10) is an inside living hinge including a hinge web 204 having a width designed to accommodate the combined thicknesses of wall panels 28*a,b*, 32*a,b* between wall panels 34*a* and 30*a* in the collapsed position. Each of the horizontal hinges 36*e-h* is an inside hinge having a cutaway portion on an exterior side thereof to reduce stresses therein when the container 200 is in the collapsed position. The diagonal hinges 38*a*, 38*b*, and 38*c* are outside hinges and include a hinge web 206 smaller than hinge web 204 to reduce the thickness of the hinges when in the collapsed position. The vertical corner hinge 36*d*, horizontal hinges 36*h* and 36*g*, and diagonal hinge 38*a* converge at a single thickness corner 208, shown in FIG. 9, which is also the same as single thickness corner 210. The vertical corner hinge 36*c*, horizontal hinges 36*g* and 36*f*, and diagonal hinge 38*b* converge at a double thickness corner 212, which is also the same as double thickness corner 214. When the container 200 is in the expanded position, the diagonal hinge 38*b* twists along the length thereof from each corner 212 and 214, where the panels 26*a* and 26*b* are level with each other, toward an intersection with the step 202, where the panels 26*a* and 26*b* are offset from each other. Protrusions, such as feet 216, are disposed on an exterior surface of the panels 26*a*, 26*b* and have different heights to compensate for the offset of the panel 26*a* from the panel 26*b* at the step 202 so that the expanded container 200 sits stably when placed on a flat support surface. Each side wall 28, 30, 32, and 34 is slightly trapezoidal having an upper edge 46 that is slightly longer than the bottom edge 47 in order to provide a draft angle along the side edges of each side wall of between approximately 0.75° and 1.5° for molding purposes. In order to form the square opening 48, the side walls 28 and 32, in one embodiment, have smaller draft angles than side walls 30 and 34 in order to adjust for the offset caused by the steps 202 in the wall panels 30*a* and 34*a*. In another embodiment, each side wall 28, 30, 32, and 34 has the same draft angle. In order to accommodate the draft angles, the diagonal hinges 38*a* and 38*c* extend from single thickness corners 208 and 210, respectively, and terminate at a position slightly laterally offset from the upper corners 42*a* and 42*b*, respectively, which allows the side wall panels to collapse without overlapping. A lip 218 extends along an exterior side of the upper edges 46 for snap-fit retention of a lid (not shown) when the container 200 is in the expanded position. In one embodiment, each of the wall panels 26*a,b*, 28*a,b*, 30*a*, 32*a,b*, and 34*a* has a substantially constant thickness. In another embodiment, one or more of the wall panels 26*a,b*, 28*a,b*, 30*a*, 32*a,b*, and 34*a* have varying thicknesses to accommodate structural and manufacturing purposes, such as offsetting warpage caused by bending of the completed container or by cooling of recently formed panels. In a further embodiment, the wall panels are formed of polypropylene having a thickness between about 0.01 and about 0.04 inches (about 0.25-about 1.02 mm), and the hinges are formed of polypropylene having a thickness between about 0.001 and about 0.015 inches (about 0.025-about 0.38 mm). In a still further embodiment, the wall panels have a thickness between about 0.001 and about 0.5 inches (about 0.025 mm-about 13 mm), and the hinges have a thickness between about 0.0001 and about 0.3 inches (about 0.0025 mm-about 7.6 mm).

Figure 14:
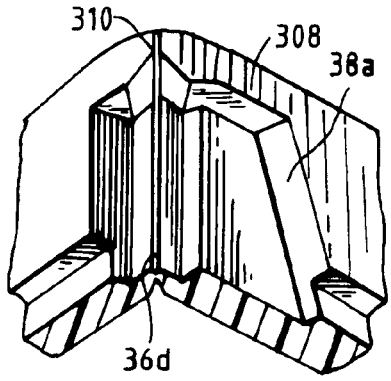
FIG. 14 is an enlarged partial isometric cutaway view of an upper corner on the collapsible container of FIG. 11 generally along the lines 14-14 of FIG. 11.

In FIGS. 11-14, another collapsible container 300 according to the present invention is shown. The collapsible container 300 is similar to the collapsible containers 22 and 200 in that opposing side walls 28 and 32 are divided into opposing triangular wall panels 28*a*, 28*b*, and 32*a*, 32*b* by diagonal hinges 38*a* and 38*c*, respectively, bottom wall 26 (best seen in FIG. 12) is divided into two triangular wall panels 26*a* and 26*b* by a diagonal hinge 38*b*, and side walls 30 and 34 are each defined by a single wall panel 30*a* and 34*a*, respectively. The diagonal hinge 38*b* is an out-of-plane arched hinge that is arched convexly away from the interior space 44 when the collapsible container 300 is in the fully expanded position. In addition, a leg 302 extends downwardly from each of the side walls 28, 30, 32, and 34 beyond the bottom wall 26 to form a cavity or space between the bottom wall and a supporting surface, such as a tabletop (not shown), when the container 300 is laid on the supporting surface in the expanded position, which provides space for the diagonal hinge 38*b* to arch downwardly out of the plane of the bottom wall 26. Arching the diagonal hinge 38*b* convexly or downwardly locks the hinge in a position that helps maintain the collapsible container 300 in the expanded position, because, in this embodiment, the diagonal hinge folds towards the interior space 44 to collapse the container into the substantially flat position. Steps 202 formed in the side walls 30 and 34 and the bottom wall 26 are adapted to allow the collapsible container 300 to collapse substantially flat over different numbers of wall panel layers in the collapsed position as previously described herein (best shown, for example, in FIG. 8). A locking mechanism 306 (best shown in FIG. 13) is located at opposite vertical corners to automatically lock the collapsible container 300 in the expanded position when the collapsible container is converted from the collapsed position to the expanded position. The locking mechanism 306 includes a first interlocking portion 306*a* extending from the wall panel 28*b* and a second interlocking portion 306*b* extending from the wall panel 30*a* along the respective upper edges 46 thereof. The first interlocking portion 306*a* includes a female recess that releasably interlocks with a male projection on the second interlocking portion 306*b* when the collapsible container 300 is converted into the expanded position. In one embodiment, the female recess is circular and the male projection is a complementary circular shape coplanar with the female recess that resiliently snap-fits therein. As shown in FIG. 14, a lip 308 extending along an outer periphery of the upper edge 46 of the container 300 has a slit 310 therethrough located at the corners of the collapsible container extending inwardly to the respective vertical corner hinges 36*b* and 36*d*, which allows the corners to fold more easily into the collapsed position.

Figure 15:
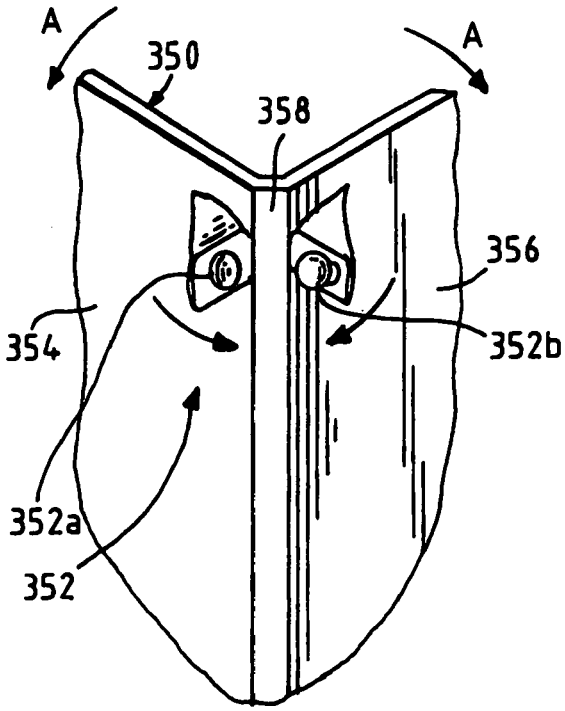
FIG. 15 is an enlarged partial isometric view of still another interlocking mechanism on a collapsible container.
Figure 16:
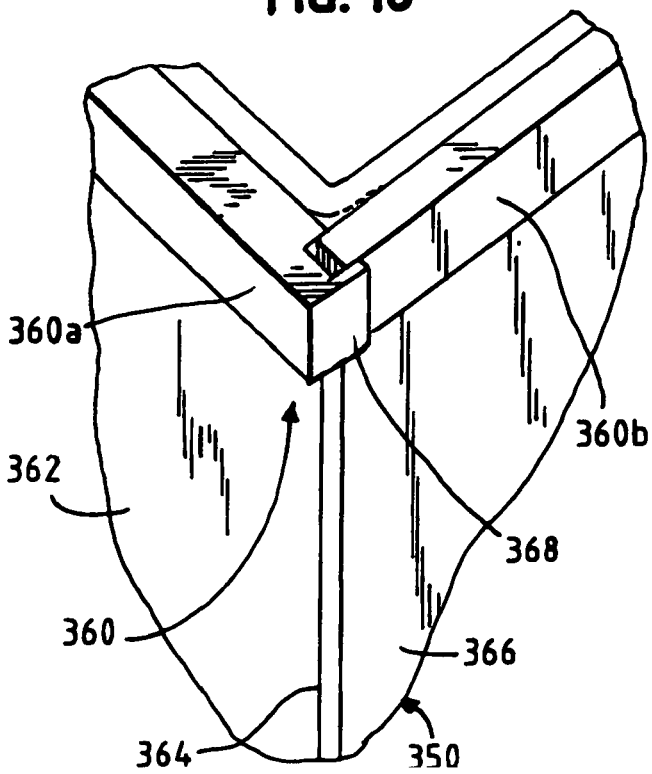
FIG. 16 is an enlarged partial isometric view of a further interlocking mechanism on a collapsible container of the invention.

In FIG. 15, a collapsible container 350 according to the present invention includes another locking mechanism 352 having a first interlocking socket portion 352*a* carried on an exterior side of a wall panel 354 that releasably interlocks with a second interlocking ball portion 352*b* carried on an exterior side of an adjacent side wall panel 356 when the wall panels pivot around an intermediate vertical corner hinge 358 from an angle of about 0° to an angle of about 90° as shown by the arrows A. FIG. 16 shows yet another locking mechanism 360 suitable for use with a collapsible container of the present invention, such as the collapsible container 350, having a first interlocking arm 360*a* and a second interlocking arm 360*b*. The first interlocking arm 360*a* extends from side wall panel 362 past vertical corner hinge 364, and the second interlocking arm 360*b* extends from adjacent side wall panel 366 past the vertical corner hinge. The first interlocking arm 360*a* automatically resiliently interlockingly engages the second interlocking arm 360*b* as the wall panels 362 and 366 pivot along the vertical corner hinge 364 from an angle of about 0° to an angle of about 90°. A tab 368 at the end of the first interlocking arm 360*a* extends beyond the second interlocking arm 360*b* to allow a user to unlatch the interlocking arms for disengagement. Each of the locking mechanisms 306, 352, 360 may be used with any collapsible container of the invention, such as the collapsible container 300, to supplement or replace the latch 306, for example, to maintain the collapsible container in the expanded position.

Figure 17:
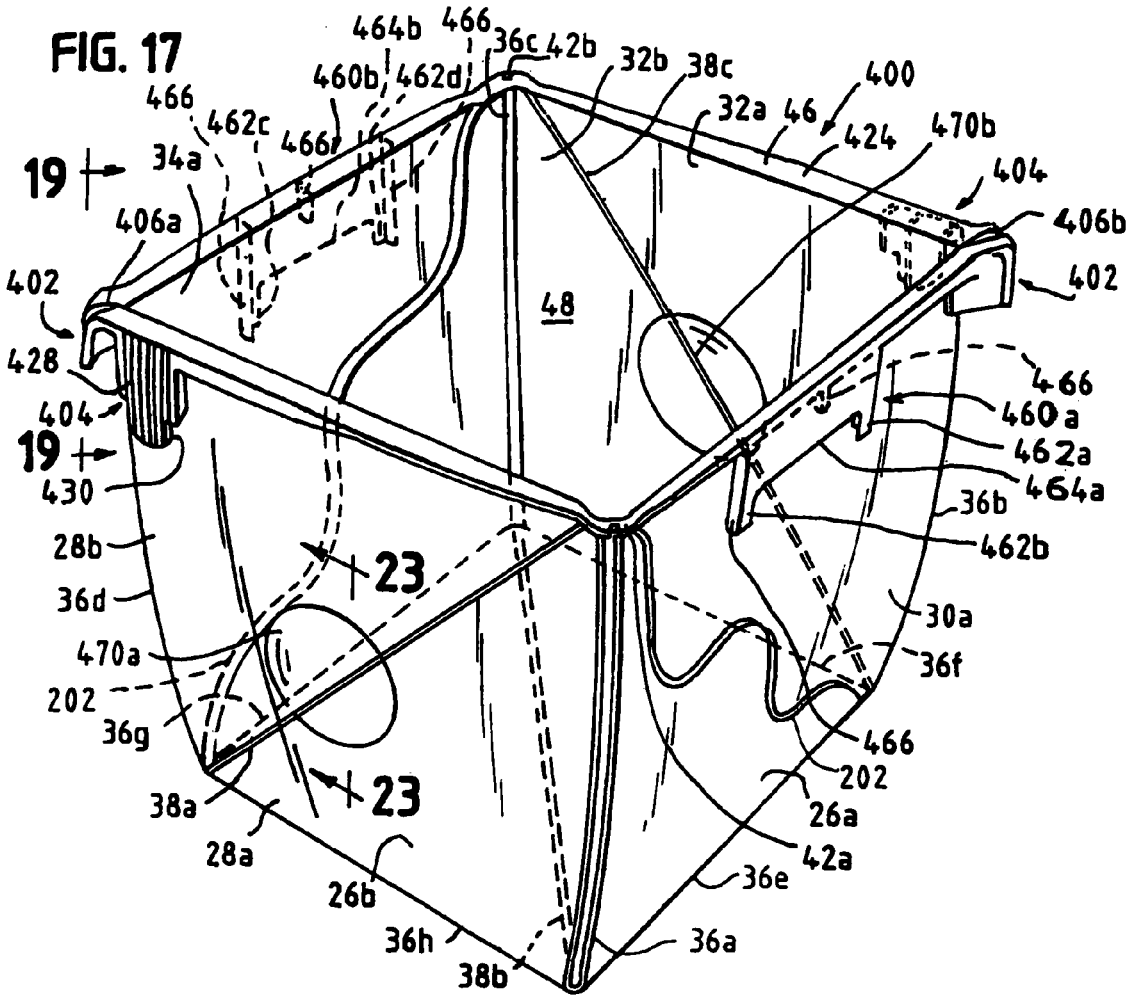
FIG. 17 is an isometric view of a collapsible container according to yet another embodiment of the present invention in a fully expanded position.
Figure 18:
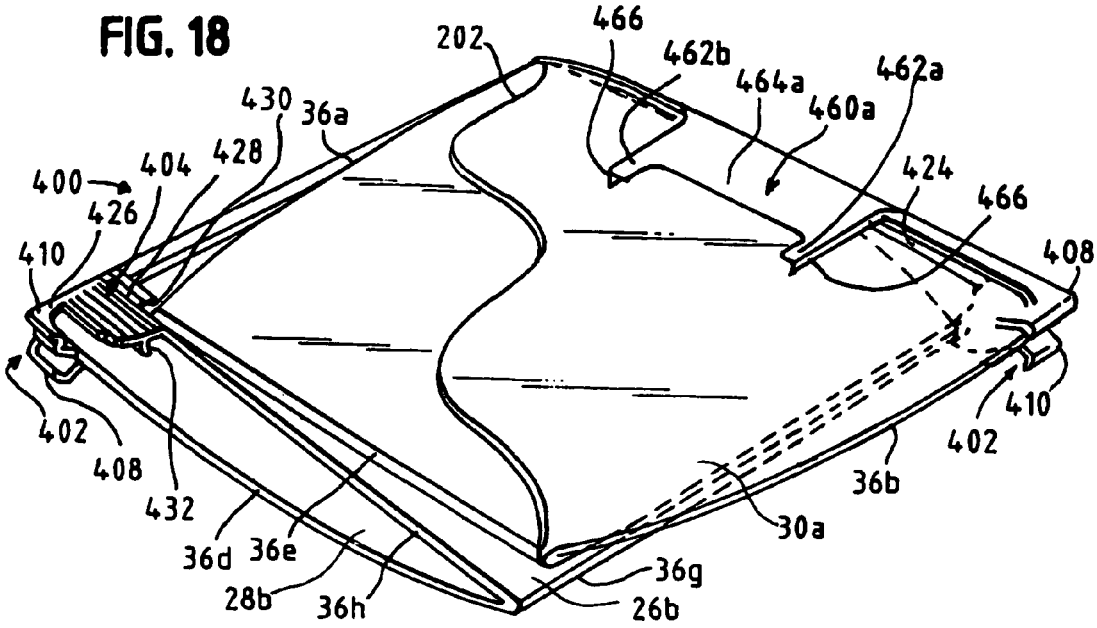
FIG. 18 is an isometric view of the collapsible container of FIG. 17 in a fully collapsed position.

Turning now to FIGS. 17-20, a container 400 according to another embodiment of the invention is collapsible and includes hold-open latches 402 and hold-closed latches 404 integrally formed therewith that automatically secure the container in an open expanded position, shown in FIG. 17, and in a substantially flat collapsed position, shown in FIG. 18. The collapsible container 400 has eight wall panels 26*a,b*, 28*a,b*, 30*a*, 32*a,b*, and 34*a*, which are hingedly joined by vertical corner hinges 36*a-d*, horizontal corner hinges 36*e-h*, and diagonal hinges 38*a-c* to be articulable between an open expanded position defining a substantially square bottom wall 26 and four upstanding side walls 28, 30, 32, and 34 and a flat collapsed position in a manner generally similar to that described for the collapsible container 22, except that side walls 28, 30, 32, and 34 are substantially trapezoidal to form arched out-of-plane vertical corner hinges similar to those described for the container 100. Further, the hinges are all substantially similar to the corresponding variable width hinges described previously for the container 200. In this embodiment, the container 400 is made of a single mass of resilient thermoplastic, such as polypropylene, and all the hinges 36*a-h* and 38*a-c* have a thickness less than about 0.015 inches (about 0.38 mm) to reduce the effect of plastic memory therein and still have sufficient durability to cycle many times without breaking or splitting. In one embodiment, the wall panels 26*a,b*, 28*a,b*, 30*a*, 32*a,b*, and 34*a* have a thickness between about 0.005 inches (about 0.13 mm) and about 0.5 inches (about 13 mm), and the hinges 36*a-h* and 38*a-c* have a thickness between about 0.001 inches (about 0.025 mm) and about 0.015 inches (about 0.38 mm). In another embodiment, the wall panels 26*a,b*, 28*a,b*, 30*a*, 32*a,b*, and 34*a* have a thickness of about 0.025 inches (about 0.64 mm), and the hinges 36*a-h* and 38*a-c* have a thickness of about 0.005 inches (about 0.13 mm).

Figure 19:
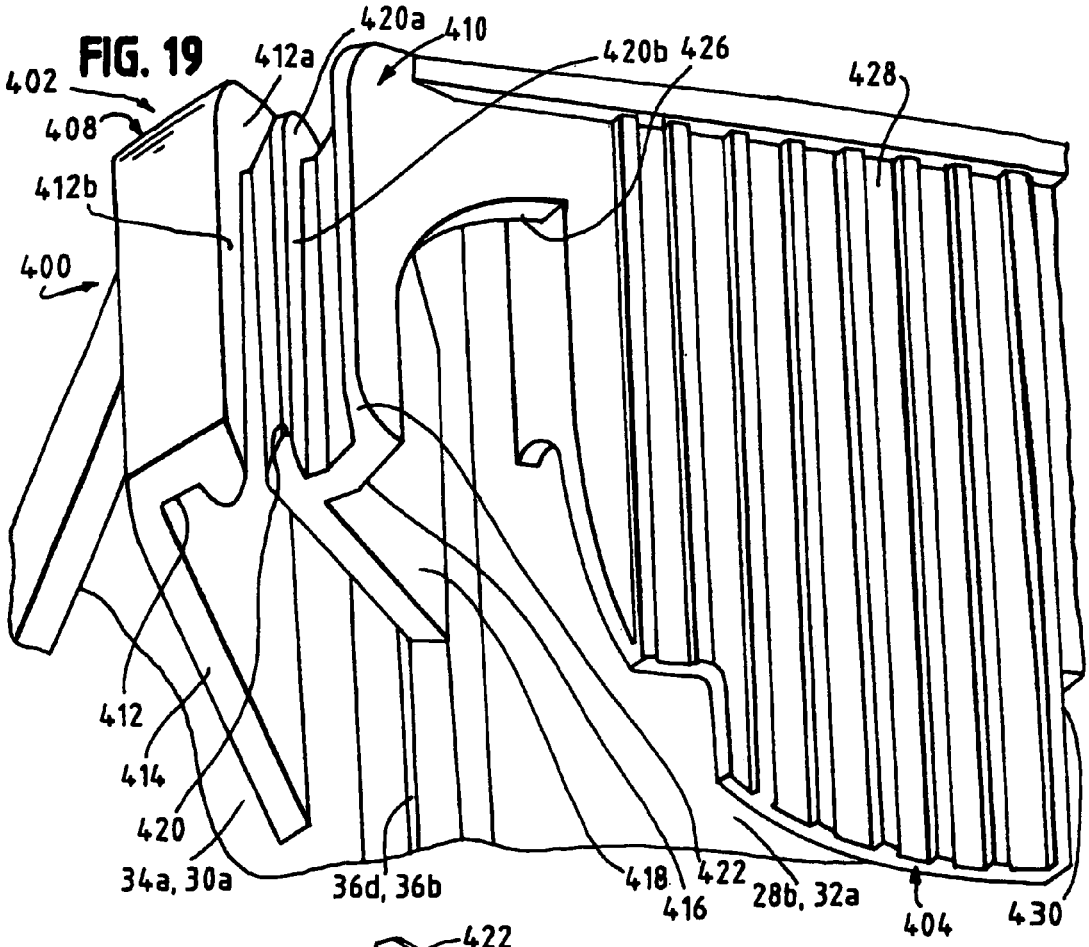
FIG. 19 is an enlarged partial isometric cutaway view of a latch assembly on the collapsible container of FIG. 17 generally along lines 19-19 of FIG. 17.
Figure 20:
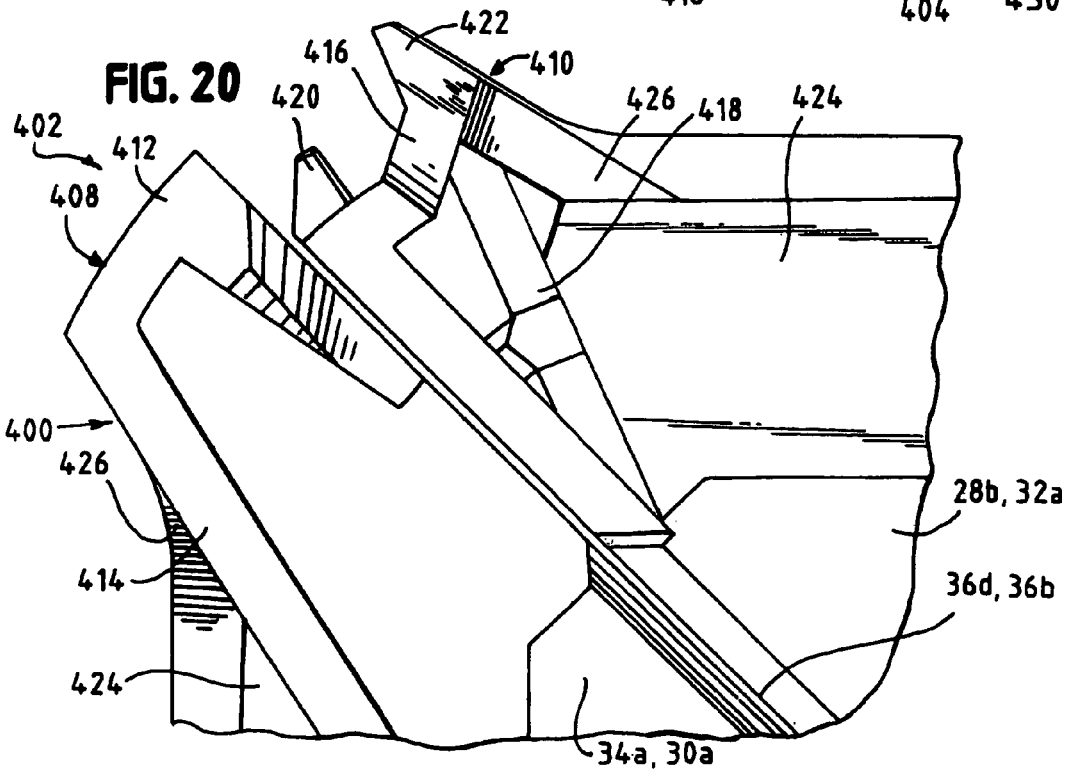
FIG. 20 is an enlarged bottom partial view of the latch assembly shown in FIG. 19.

The hold-open latches 402, which automatically releasably lock the container 400 in the open expanded position, are located on two diagonally opposite vertical corners 406*a*, 406*b* along top edge 46 of the wall panels at the opening 48. As best seen in FIGS. 19 and 20, each of the hold-open latches 402 includes a hooked interlocking member 408 and a groove interlocking member 410. The hooked interlocking member 408 has a hook member 412 disposed at a distal end of an extension member 414 that protrudes angularly from an exterior surface of the wall panel 34*a* spaced from the generally vertical corner hinge 36*d*. The hook member 412 has a horizontal portion 412*a* that extends substantially perpendicularly radially away from the generally vertical corner hinge 36*d* and a vertical portion 412*b* that extends downwardly from the horizontal portion substantially parallel with and spaced from the generally vertical corner hinge. The vertical portion 412*b* points toward the generally vertical corner hinge 36*d*, and the horizontal portion 412*a* points toward the bottom wall 26. The groove interlocking member 410 has a groove portion 416 at a distal end of an extension member 418 that protrudes angularly from an exterior surface of the wall panel 28*b* at the generally vertical corner hinge 36*d*. The groove portion 416 is defined by and between an interference member 420 spaced from a stop member 422. The interference member 420 has a horizontal portion 420*a* and a vertical portion 420*b* that engage with the horizontal portion 412*a* and vertical portion 412*b*, respectively, of the hook member 412. The hook member 412 and the groove portion 416 are spaced substantially radially outwardly from the generally vertical corner hinge 36*d*. Opposing leading edges of the hook member 412 and the interference member 420 are angled so as to resiliently slide past each other and automatically interlock as the wall panels 28*b*, 34*a* articulate about the generally vertical corner hinge 36*d* into a substantially perpendicular relation, and the hook member 412 abuts against the stop member 422 to prevent the wall panels 28*b*, 34*a* from rotating substantially beyond perpendicular. In one embodiment, the stop member 422 is arranged so that the wall panels 34*a* and 28*b* can extend between about 11 and about 20° beyond the perpendicular so that the leading edge of the hook member 412 can completely slide past the leading edge of the interference member 420 and interlock slightly beyond a 90° angle. A horizontal flange or upper lip 424 protrudes outwardly along the top edge 46 of each of the wall panels 28*b*, 30*a*, 32*a*, and 34*a* and tapers to no width or a very small width a short distance from respective adjacent top corners 42*a*, 42*b*, preferably at or before the location of the end of the respective diagonal hinges 38*a*, 38*c* and steps 202. The horizontal flange 424 buttresses the respective hooked interlocking members 408 and groove interlocking members 410 to prevent the wall panels 28*b*, 34*a* and 30*a*, 32*a* from extending substantially beyond perpendicular with respect to each other. In addition, a gusset 426 extending between each horizontal flange 424 and the respective hooked interlocking member 408 and groove interlocking member 410 provides additional reinforcement thereto. In this embodiment, the steps 202 are wavy rather than linear in order to provide a visual cue to a user that the steps are not hinges.

A hold-closed latch 404 is disposed adjacent to each hold-open latch 402. Each hold-closed latch 404 includes a retention member that is spaced from the respective wall panel (e.g., 28*b*) and engages a portion of an adjacent wall panel (e.g., 28*a* or 30) and/or an adjacent hinge (e.g., 36*e*) when in the flat collapsed position. In the embodiment shown in detail in FIG. 19, the retention member includes a pad 428 that is spaced from and substantially parallel to the wall panel 28*b* and frictionally engages the wall panel 28*a* and/or 30*a* in the collapsed position. An edge of the pad at a cutout or notch 430 resiliently snap-fits with an end portion of the hinge 36*e* as the container 400 articulates into the flat collapsed position. The pad 428 is disposed entirely within the bounds of the wall panel 28*b* because the diagonally opposite corner of the wall panel 28*a* is displaced from a peripheral edge of the wall panel in the flat collapsed position due to the curvature of the generally vertical corner hinges 36*a* and 36*d*, which thereby reduces the size of the outline of the container 400 in the collapsed position. In another embodiment, the pad 428 aligns with the corner and does not have or require the cutout notch 430, and the hold-closed latch 404 includes a clip member that overlaps a diagonally opposite corner portion of the wall panel 28*a* in the collapsed position. In further embodiments, the hold-closed latch 404 may include adhesives, and/or hook-and-loop fasteners.

In operation, the hold-open latches 402 actuate as the wall panels 28*b*, 34*a* and 30*a*, 32*a* articulate between included angles of about 0° and about 90°, and the hold-closed latches actuate as the wall panels 28*a*, 28*b* and 32*a*, 32*b* articulate between included angles of about 180° and about 0°. For example, as the wall panels 28*b* and 34*a* rotate about the generally vertical hinge 36*d* from about a 0° angle in the flat collapsed position to about a 90° angle in the expanded position, the hooked interlocking member 408 and the groove interlocking member 410 rotate toward each other and automatically resiliently engage so as to maintain the wall panel 28*b* substantially perpendicular with the wall panel 34*a*. The wall panels 28*b* and 34*a* are articulated slightly beyond 90° to fully interlock the hook member 412 and the groove portion 416, and then are allowed to relax back toward the substantially perpendicular state. To disengage the hold-open latches 402, a user may simply urge the collapsible container 400 toward the flat collapsed position, which causes the hooked interlocking member 408 to automatically resiliently disengage from the groove interlocking member 410. Then, as the wall panels 28*a* and 28*b* rotate about the diagonal hinge 38*a* from about a 180° angle in the expanded position to about a 0° angle in the flat collapsed position, a portion of the horizontal hinge 36*e* near the corner of the wall panels 28*a*, 30*a* approaches and frictionally engages the edge of the pad 428 in the cutout portion 430 to hold the wall panels 28*a* and 28*b* folded at the substantially 0° angle. To disengage the hold-closed latches 404, the user may simply urge the container 400 back toward the expanded position, or the pads 428 may be pried away to release the horizontal hinge 36*e*. In one embodiment, the pad 428 is pivotally spaced from the wall panel 28*b* by a strut 432 (best shown in FIG. 18) such that pressing on one end of the pad pivotably disengages the other end of the pad from the horizontal hinge 36*e*. In the present embodiment, the hold-open latches 402 make an audible cue, such as a clicking sound, or "pop," and a tactile sensation, such as a "snap," when they engage and disengage, and the hold-closed latches 404 make an audible cue when they engage. (Only the hold-open and hold-closed latches near corner 406*a* are described in detail herein, it being understood that the hold-open and hold-closed latches near corner 406*b* are substantially identical with respect to corresponding portions of the corresponding wall panels.)

In one embodiment, the container 400 is injection molded as a unitary mass of polypropylene in or near the expanded position, which allows the hold-open latches 402 to be formed without special moving mold parts that would require a secondary sliding action during the mold process. Further, this molding technique also produces a container that is substantially leak proof. When molded in the expanded position, the mold parts that define the hooked interlocking member 408 and the groove interlocking member 410 form a gap therebetween so that the interlocking members are molded in an operable condition, i.e., a condition that allows the interlocking members to lock and unlock, without requiring a subsequent step of cutting the interlocking members apart or removing excess material.

Figure 21:
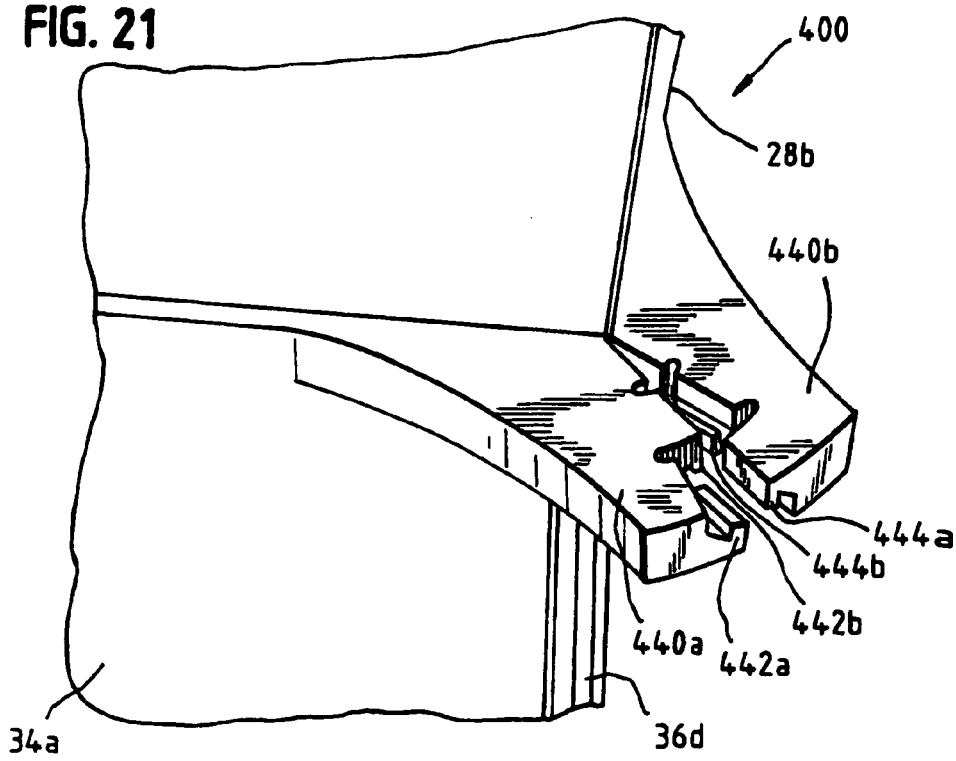
FIG. 21 is an enlarged partial isometric view of a latch assembly according to another embodiment of the invention.
Figure 22:
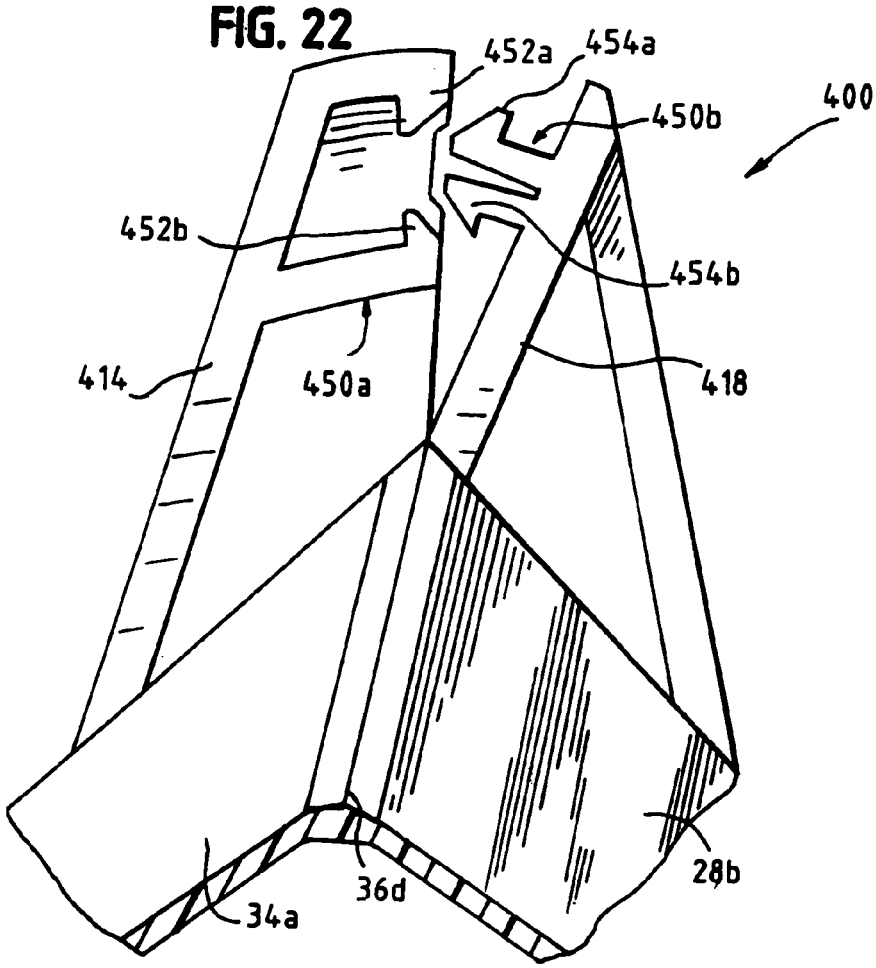
FIG. 22 is an enlarged bottom partial view of a latch assembly according to yet a further embodiment of the invention.

In other embodiments, other types of hold-open latches may be used with the container 400 (or any of the collapsible containers disclosed herein) to supplement or replace the hold open latches 402. For example, a hold-open latch is shown in FIG. 21 that includes two opposing clip members 440*a* and 440*b*, in which each clip member has only a horizontal portion extending perpendicularly outwardly from the respective wall panels 34*a* and 28*b*. The clip member 440*a* has a resilient upwardly pointing outer interlocking member 442*a* and a resilient downwardly pointing inner interlocking member 442*b*. The clip member 440*b* has a resilient downwardly pointing outer interlocking member 444*a* and a resilient upwardly pointing inner interlocking member 444*b*. As the wall panels 34*a* and 28*b* rotate from an included angle of about 0° to about 90°, the clip member 440*a* snaps into interlocking engagement with the clip member 440*b*, wherein the upwardly pointing outer interlocking member 442*a* releasably interlocks with the downwardly pointing outer interlocking member 444*a*, and the downwardly pointing inner interlocking member 442*b* releasably interlocks with the upwardly pointing inner interlocking member 444*b*. In FIG. 22, yet another embodiment of a hold-open latch for use with any of the containers disclosed herein, such as 400, includes a vertical interlocking portion including opposing clip members 450*a*, 450*b*. The clip member 450*a* has a vertical channel disposed at an end of an extension member 414 and defined between two inwardly-turned hooks 452*a* and 452*b*. The clip member 450*b* has two vertical outwardly-turned hooks 454*a*, 454*b* disposed at an end of the extension member 418. The inwardly-turned hooks 452*a*, 452*b* receive and interlock with the outwardly-turned hooks 454*a*, 454*b* to maintain the container 400 in the expanded position. A further embodiment of a hold-open latch includes an elastic strap (not shown) extended across one or more of the corners 42*a,b* and/or 406*a,b*, which urges the container 400 (or 22) toward the expanded position and causes the container to spring open when released from the collapsed position. Yet a further embodiment of a hold-open latch is a clip (not shown) that folds down over one or more of the diagonal hinges 38*a-c* to stiffen and maintain the container in the expanded position.

Referring again to FIGS. 17 and 18, a bracket 460*a,b* is disposed on an exterior side of each side wall 30, 34 of the collapsible container 400. Further, the brackets 460*a,b* include spaced apart detents 462*a,b* and 462*c,d*, respectively, and posts 464*a,b*, respectively. In the present embodiment, the brackets 460*a,b* also include one or more flanges 466 that stabilize the brackets 460*a,b*. For example, in FIG. 17 the brackets 460*a,b* are secured to the respective side walls 30, 34 by flanges 466 disposed on side edges of the brackets and an additional flange 466 is connected to the side walls and to a generally centered upper portion of the brackets. In one embodiment, the brackets 460*a,b* are adapted for use as handles for the container 400. In another embodiment described hereinafter, the brackets 460*a,b* are also adapted to facilitate attachment of a lid to the container.

In the present embodiment, the brackets 460*a,b* are disposed on side walls 30 and 34 so that they do not interfere with the other side walls when the container 400 is folded into the collapsed position. However, in a different embodiment, the brackets 460*a,b* are disposed on side walls 28 and 32 and are adapted to allow the container 400 to fold into a substantially flat collapsed position, for example, by being substantially flush with the horizontal flange 424.

The collapsible container 400 of FIG. 17 also includes stabilizers, such as 470*a* or 470*b*, for stabilizing the container in an open expanded position. In one embodiment, the stabilizers 470*a,b* are deformed portions in the side walls 28 and 32, respectively. The stabilizers function to prevent or resist the side walls from folding inwardly when fully expanded. In the embodiment of FIG. 17, the stabilizers 470*a,b* are circular and are disposed across the diagonal hinges 38*a,c*, wherein the center of the circular stabilizers are generally disposed at a mid-point of the diagonal hinges. In other embodiments, the stabilizers can take on any other shape, such as, oval, triangular, rectangular, star shaped, tear-drop, or any other symmetrical or non-symmetrical shape. Further, the center of the stabilizers 470*a,b* may be disposed at any point along the diagonal hinges 38*a,c*, and/or the center of the stabilizer may be offset from the respective diagonal hinge.

Figure 23:
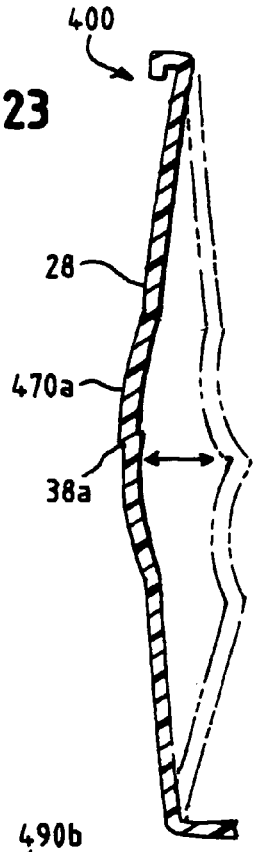
FIG. 23 is an enlarged fragmentary cross-sectional view taken generally along the line 23-23 of FIG. 17.
Figure 24:
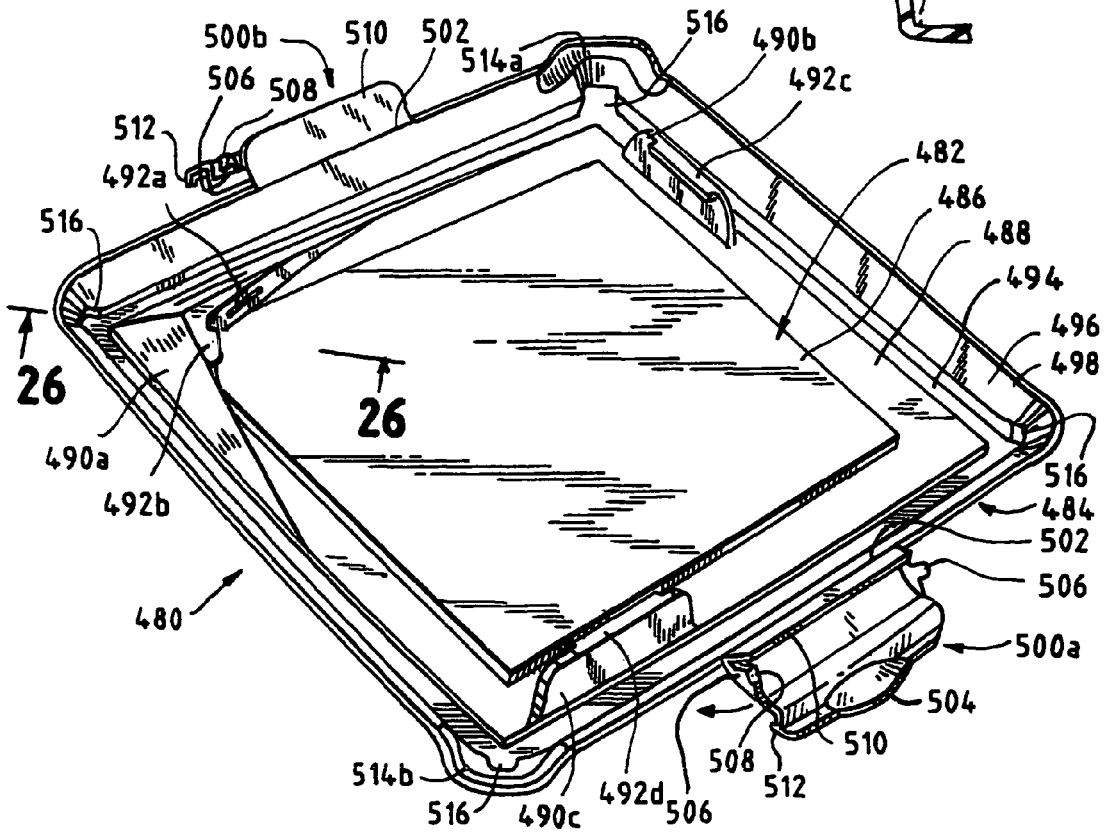
FIG. 24 is an isometric view of another lid adapted for use with a collapsible container of the present invention.

FIG. 23 shows a cross-section generally along lines 23-23 of the stabilizer 470*a* of FIG. 17. In operation, when the container 400 is fully expanded, the stabilizer 470*a* projects out of the plane of the side wall 28 and takes on a shallow, dome-like form that releasably locks the diagonal hinges 38*a,c* in a convexly bowed position, thereby resisting or preventing the hinges from unwantedly folding inwardly until the stabilizers are pushed-in. The stabilizer 470*b* operates in the same manner as the stabilizer 470*a*. The stabilizers 470*a,b* are pushed towards the interior of the container 400 to unlock the diagonal hinges 38*a,c* and allow the container 400 to transition towards the collapsed position. Further, the stabilizers 470*a,b* provide a visual target that indicates a good location to push to begin the collapsing process of the container 400.

Similar to the lid 24 of FIGS. 1-3, another embodiment of a lid 480 is shown in FIGS. 24-33 for covering the mouth 48 of the container 400 in the expanded position and receiving the entire container in the flat collapsed position. The lid 480 has an interior or product side 482, and an exterior or stacking side 484. The product side 482 includes a generally square, central plate 486 for covering the mouth 48 of the container 400. The exterior side of the central plate 486 defines a recess surrounded by a peripheral collar portion 488, which is dimensioned to receive the bottom footprint of the expanded container 400 to facilitate stacking of an expanded container thereon. Inner walls 490, such as a wall section 490*a* and posts 490*b* and 490*c* include one or more projections or snap-fit detents for securing the container 400 in the lid 480 in the flat collapsed position. For example, as seen more clearly in FIGS. 26-29, the wall section 490*a* includes snap-fit detents 492*a*, 492*b*, and posts 490*b* and 490*c* include snap-fit detents 492*c* and 492*d*, respectively, which resiliently engage edges of the wall panels of the collapsible container 400 in the collapsed position.

A channel 494 is defined around the outer periphery of the central plate 486 between the peripheral collar portion 488 and a peripheral flange 496, which defines a sidewall around an outermost periphery of the lid 480. The channel 494 receives the sidewalls 28, 30, 32, 34 of the container 400, which helps stabilize the container in the expanded position and in one embodiment also forms a liquid-tight seal therewith. The peripheral flange 496 includes an outwardly turned rim portion 498, which helps guide the upper lip 424 of the side walls 28, 30, 32, 34 into the channel 494.

Figure 25:
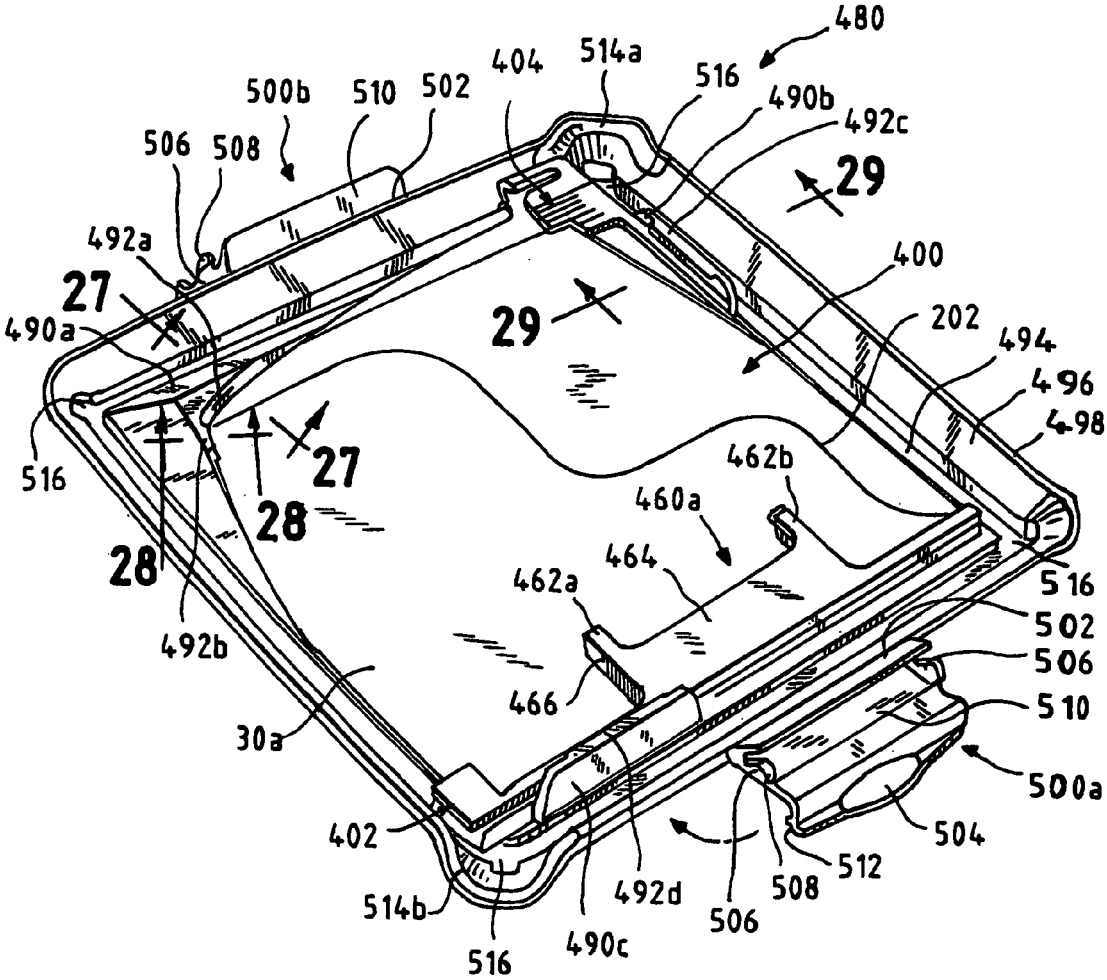
FIG. 25 is an isometric view of the collapsible container of FIG. 17 in a collapsed position and secured in the lid of FIG. 24.
Figure 26:
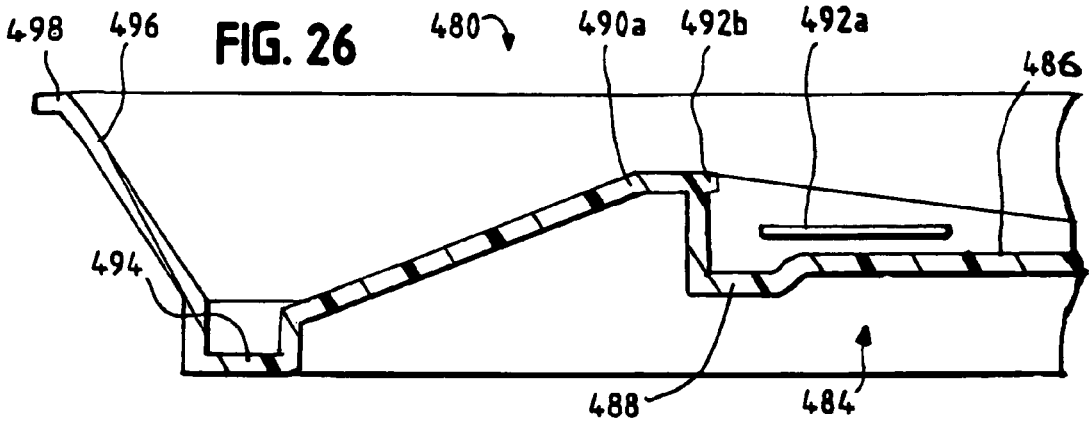
FIG. 26 is a fragmentary cross-sectional view taken generally along the lines 26-26 of FIG. 24.
Figure 27:
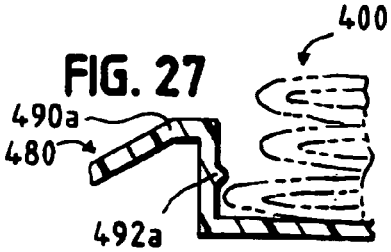
FIG. 27 is a fragmentary cross-sectional view taken generally along the lines 27-27 of FIG. 25.
Figure 28:
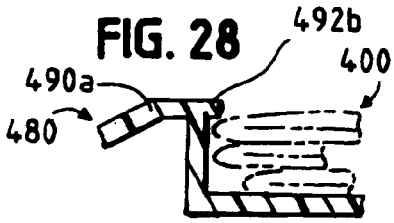
FIG. 28 is a fragmentary cross-sectional view taken generally along the lines 28-28 of FIG. 25.
Figure 29:
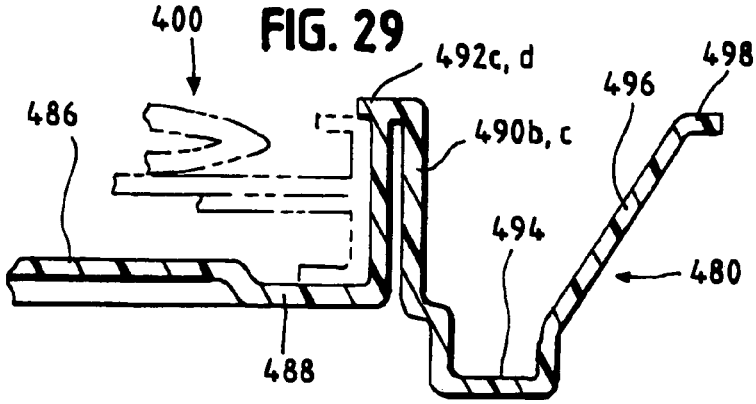
FIG. 29 is a fragmentary cross-sectional view taken generally along the lines 29-29 of FIG. 25.
Figure 30:
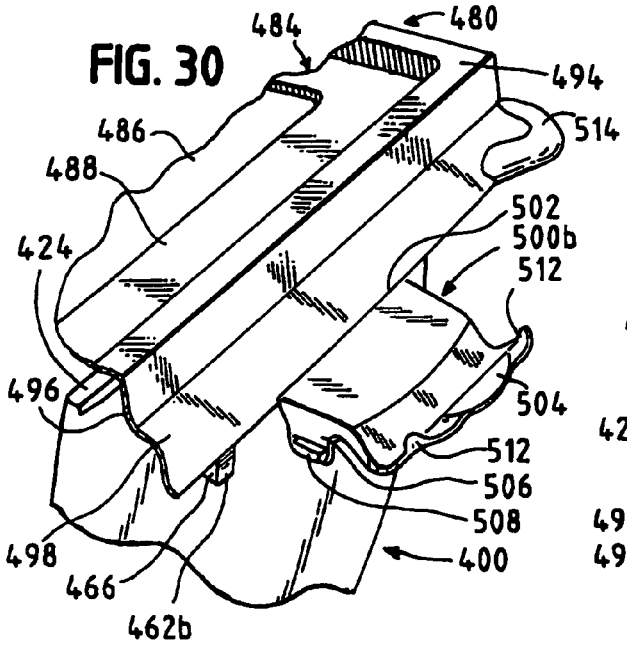
FIG. 30 is a partial isometric view of the lid of FIG. 24 on the collapsible container of FIG. 17.

In the present embodiment, the lid 480 receives and retains the collapsible container 400 in the flat collapsed position with a tapered corner of the container disposed adjacent the wall section 490*a* (as best seen in FIG. 25). The tapered corner is formed due to the curvature of the generally vertical corner hinges. The snap-fit detent 492*a* on the wall section 490*a* is adapted to secure a first side wall of the container (as seen in FIG. 27) and the snap-fit detent 492*b* on the wall section 490*a* is adapted to secure a second side wall of the container (as seen in FIG. 28). The snap-fit detents 492*c*, 492*d* on the posts 490*b,c*, respectively, are adapted to secure the container 400 in the collapsed position (as seen in FIG. 29). When the container 400 is in the expanded position, the posts 490*b*, 490*c* press outwardly against an inside surface of one or more of the container side walls 28-34 to help maintain the container 400 in the expanded position when the upper lip 424 of the container is received in the channel 494.

Figure 31:
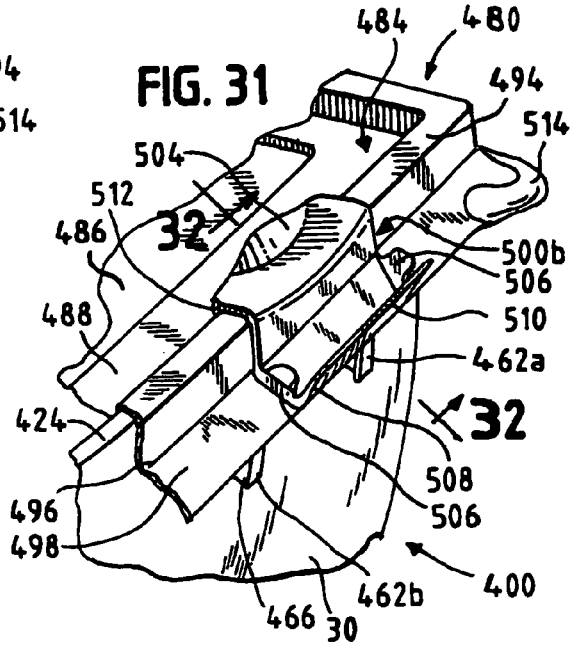
FIG. 31 is a partial isometric view of the latch of FIG. 30 in a non-use position.
Figure 32:
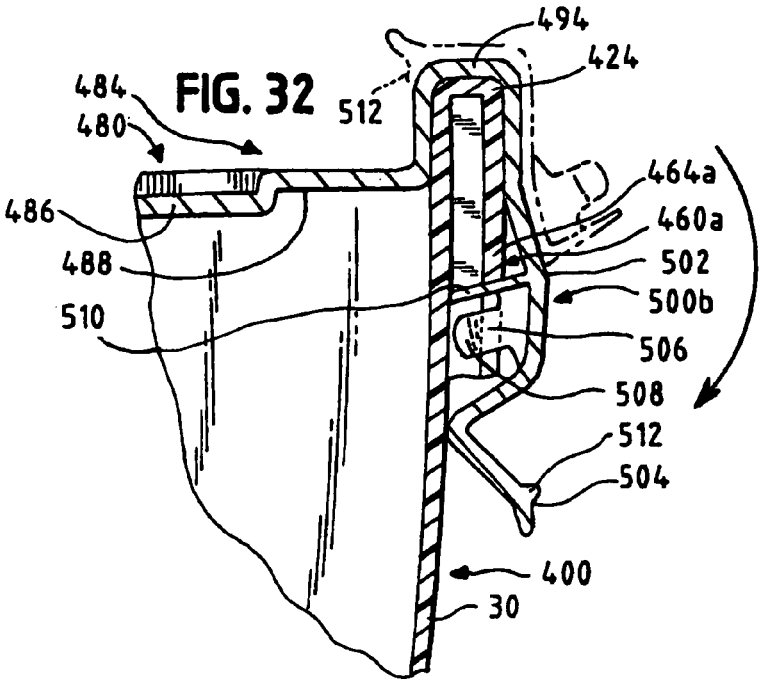
FIG. 32 is an enlarged partial cross-sectional view of the lid, latch, and collapsible container of FIG. 31 along the lines 32-32 in a latched or use position.
Figure 33:
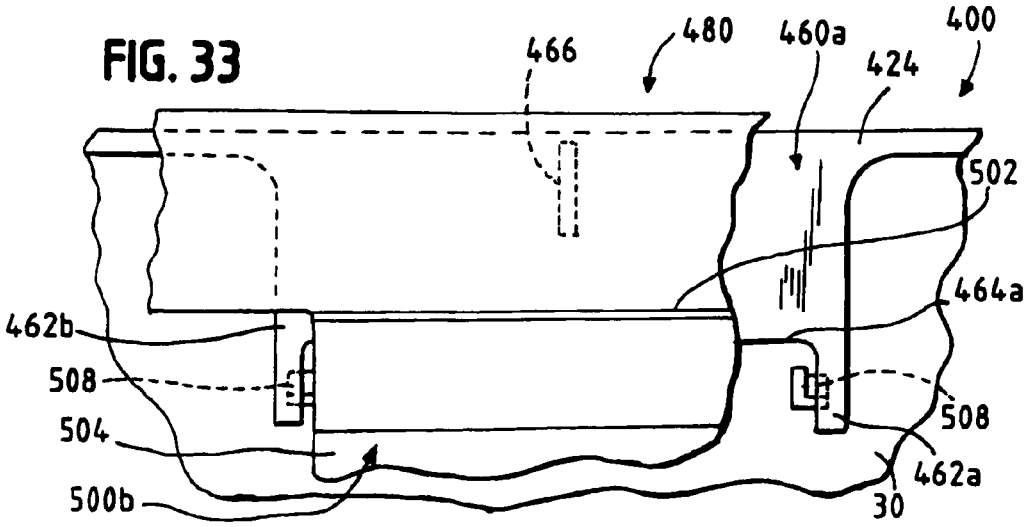
FIG. 33 is an enlarged partial front view of the latch of FIG. 32.

As best seen in FIGS. 24, 25, and 30-33, hold down latches 500*a,b* extend beyond the outwardly turned rim 498 on opposite sides of the lid 480. Each hold down latch 500*a,b* has a hinge 502 disposed between a lever 504 and the outwardly turned rim 498 that allows the lever to articulate toward and away from the side walls of the container when the upper lip 424 of the container 400 is disposed inside the channel 494 in the expanded position as shown in FIG. 32. A flexible finger 506 with a hook 508 extends from opposite side edges of the lever 504, and a cam member 510 extends from the lever toward the container 400. In one embodiment, the hold down latches 500*a,b* include one or more detents 512 extending from a distal end of the lever 502 for releasably locking the hold down latch in a non-use position shown in FIG. 31. The lid 480 further includes corner tabs 514*a,b* that facilitate prying the lid from the container 400 in the expanded position to gain access to the interior of the container. The corner tabs 514*a,b* also facilitate prying the lid from the container 400 when the container is the flat collapsed position and retained by the lid 480. Further, the channel 494 in one embodiment includes a recess 516 that is shaped to receive and hold the hold open latches 402 together when the lid 480 is disposed on the container 400 in the expanded position.

FIGS. 30-33 illustrate some possible interactions between the hold down latch 500*b* and the bracket 460*a*. (The hold down latch 500*a* and bracket 460*b* interact in the same manner.) When the lid 480 is disposed on the upper lip 424 to cover the opening 48, the lever 504 may be rotated toward the container 400 such that the hooks 508 on the fingers 506 interlockingly snap-fit outwardly under the detents 462*a,b*. The lever 504 may also be rotated away from the container 400 and secured adjacent to the lid 480 in a non-use position by an interference fit formed by the detents 512 and the channel 494 on the exterior side 484 of the lid (as seen in FIG. 31). In one embodiment, the cam member 510 pries against the post 464*a* as the lever 504 is articulated downwardly to pull the lid 480 tightly onto the upper lip 424 of the container 400.

Figure 34:
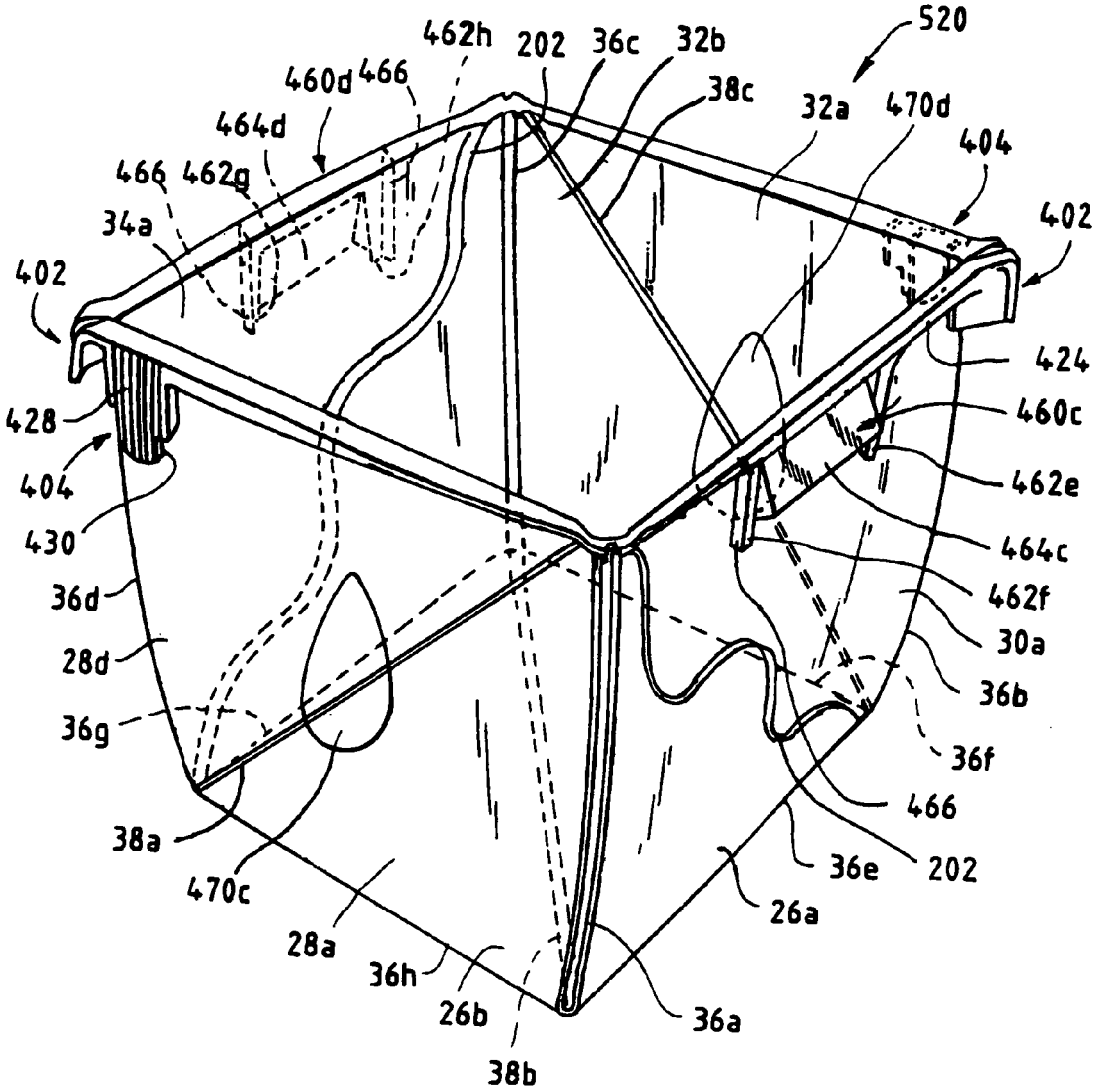
FIG. 34 is an isometric view of a collapsible container according to a further embodiment in a fully expanded position.

FIG. 34 shows another embodiment of a collapsible container 520 that is similar in structure and function to the collapsible container 400 of FIG. 17 with differences as noted hereinafter. The container 520 includes hold open latches 402 and hold closed latches 404 similar to the latches shown in FIGS. 19-20. However, other embodiments of hold open and hold closed latches can be used, such as the hold open and hold closed latches of FIGS. 21 and 22. In addition, the container 520 includes tear drop shaped stabilizers 470*c,d*, which function similarly to the circular stabilizers 470*a,b* illustrated in FIGS. 17 and 23. A center of the stabilizers 470*c,d* is offset from a mid-point of the diagonal hinges 38*a,c*. Further, the container 520 includes brackets 460*c,d* similar to the brackets 460*a,b*, except that the brackets 460*c,d* include detents 462*e,f* and 462*g,h*, respectively, and posts 464*c,d*, respectively. The posts 464*c,d* project downwardly and outwardly from the upper lip 424 of the container 520 at an acute angle. In one embodiment, posts 464*c,d* provide handles for the container 520 when in the expanded position. In addition, the posts 464*c,d* are flexible portions of the brackets 460*c,d*, respectively, that are adapted to compress inwardly toward the respective side walls 30, 34 to facilitate the container 520 folding into the flat collapsed position. In particular, the flexible posts 464*c,d* on the container 520 compress inwardly when the container in the collapsed position is received in a lid, such as the lid 480 or the lid 530 of FIG. 35, so that the container 520 is retained in a substantially parallel orientation with the lid.

Figure 35:
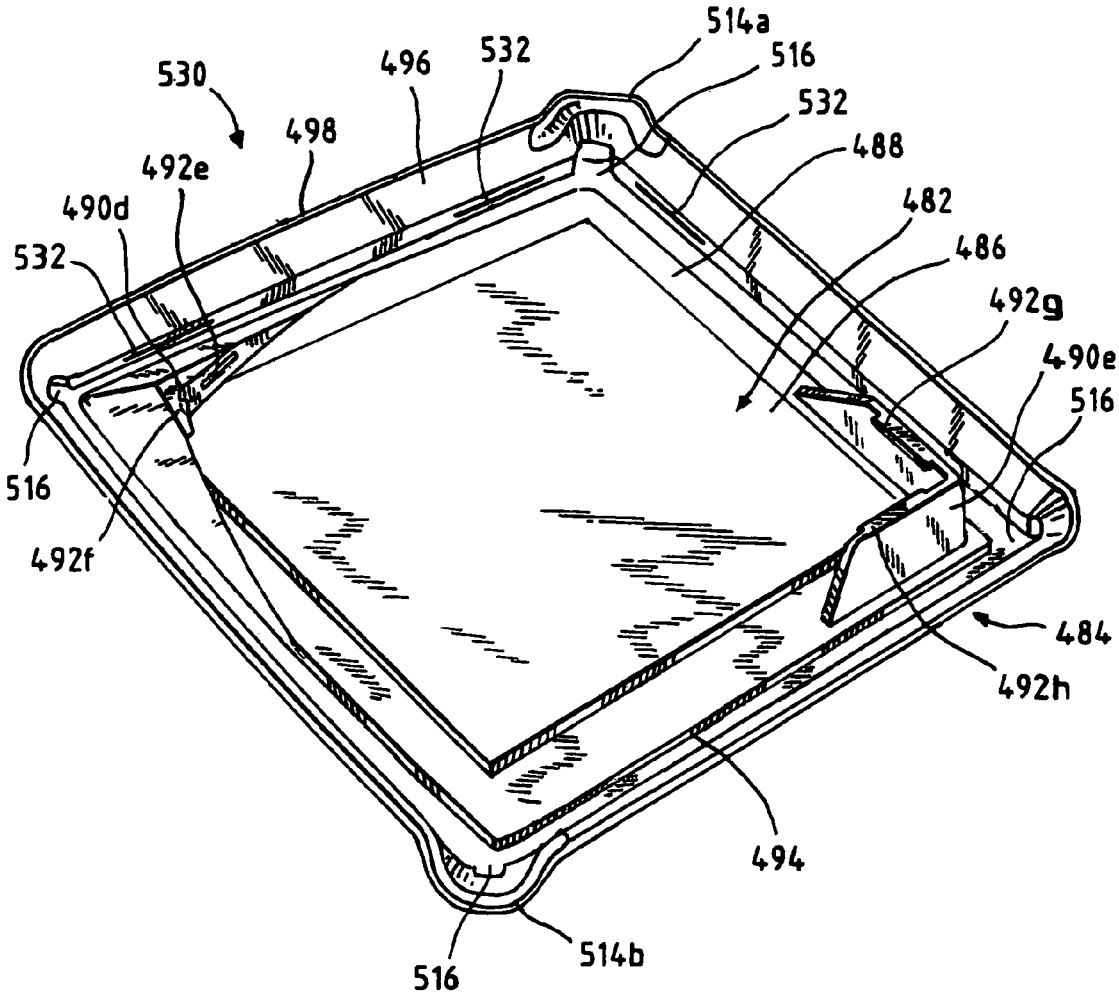
FIG. 35 is an isometric view of yet another lid adapted for use with a collapsible container of the present invention.

Referring to FIG. 35, a lid 530 is adapted for use with any of the collapsible containers described herein, such as the container 520 of FIG. 34, for example. The lid 530 is similar to the lid 480 and is adapted to cover the collapsible container 520 in the expanded position and receive the container in the collapsed position in a generally similar manner, but with some differences as described hereinafter. A wall section 490*d* and a post 490*e* project from the collar portion 488 on the interior side 482 of the lid 530. The wall section 490*d* is similar to the wall section 490*a* and includes snap-fit detents 492*e,f* that retain side walls of the collapsible container 520 in the collapsed position. The post 490*e* is similar to the posts 490*c,d* and is a generally L-shaped wall that is disposed along a diagonally opposite corner from the wall section 490*d* and further includes snap-fit detents 492*g,h*. The post 490*e* and snap-fit detents 492*g,h* are adapted to retain a generally perpendicular or square corner of the collapsible container 520 in the collapsed position and to press outwardly against the container side walls in the expanded position. The lid 530 includes one or more projections or ribs 532 disposed along the channel 494 that form an interference fit with the upper lip 424 of the container 520 in the expanded position to further secure the lid 530 to the container. In one embodiment, the lid 530 is adapted for use with the collapsible container 520 (FIG. 34), and a peripheral flange 496 disposed on the lid is angled at a substantially similar angle as the posts 464*c,d* to be compatible therewith.

In a further embodiment, the lids 480 and/or 530 are a cork-type lid having a sealing member (not shown), such as the tapered lead-in 60 of the lid 24 that seals against the inner surface of the side walls 28, 30, 32, and 34.

Now referring to FIG. 36, a collapsible container 550 according to a further embodiment is similar to the collapsible container 100 of FIG. 6 and includes features from the collapsible container 400 of FIG. 17 (as indicated by the same reference numbers) with some differences, which are noted hereinafter. The container 550 includes an anti-fold lock 552 that is disposed proximate to the hinge 36*a*. The anti-fold lock 552 includes a tab 554 connected to the container 550 adjacent the upper lip 424 at a hinge 556. In one embodiment, the tab 554 includes connectors 558, 560 that are disposed on opposite sides of the tab, and the container 550 includes connectors 562, 564 that are disposed on adjacent side walls 28, 30, respectively. The connector 558 on the tab 554 is adapted to engage connector 562 on the side wall 28, and the connector 560 on the opposite side of the tab is adapted to engage connector 564 on the side wall 30. The connectors 558-564 may be any type of suitable engagement mechanisms, for example, protrusions that form an interference fit therebetween, opposing male and female interlocking members such as a tongue and groove, adhesive strips, and/or opposing hook and loop fasteners. In addition, the container 550 includes a bracket 566 that is similar to the brackets 460*a,b* of FIG. 17. Further, the collapsible container 550 may include an anti-fold lock 552 that is disposed proximate to the hinge 36*c* (as seen in FIGS. 37 and 38). The anti-fold locks 552 proximate to the hinges 36*a,c* are similar in structure and function.

Shown most clearly in FIGS. 37 and 38, the anti-fold lock 552 articulates about the hinge 556 between a first position where the tab 554 is positioned adjacent the side wall 32 (as seen in FIG. 37) and a second position where the tab 554 is positioned adjacent the side wall 34 (as seen in FIG. 38). In the first position, the connector 558 on the tab 554 engages the connector 562 on the side wall 32. In particular, the tab 554 is secured across the diagonal hinge 38*c* and acts as a tie and/or stiffener between the hinge 36*c* and the connector 562 on the side wall 32, which thereby prevents the relative motion of the wall panels 32*a,b* about the diagonal hinge 38*c*. Specifically, the anti-fold lock 552 in the first position prevents the diagonal hinge 38*c* from folding inwardly and stabilizes the container 550 in the expanded position. In one embodiment, the tab 554 is injection molded as part of the container 550 and is made of the same material as the container, such as a resilient polymeric material. In this embodiment, the resilient characteristics of the tab 554 further serve to prevent the diagonal hinge 38*c* from folding when the anti-fold lock 552 is in the first position. In the second position, the connector 560 on the tab 554 engages the connector 564 on the side wall 34 to secure the anti-fold lock 552 against the side wall 34 in a non-use position and to allow the diagonal hinge 38*c* to fold inwardly so that the container 550 can transition toward the collapsed position.

In another embodiment, the anti-fold lock 552 does not include the connector 560 and the container 550 does not include the connector 564 on the side wall 34. In this embodiment, the tab 554 frictionally engages an edge of the bracket 566 at a notch 568 when the anti-fold lock 552 is in the second position and secured adjacent the side wall 34. The anti-fold lock 552 that is disposed proximate the hinge 36*a* can be similarly adapted to frictionally engage a bracket 566 on the side wall 30 without including the connectors 560, 564.

In yet another embodiment, the container 550 is adapted for use with a lid, such as the lid 530 of FIG. 35. In this embodiment, the anti-fold locks 552 are substantially parallel with the side walls 28-34 in the first and second positions so that the anti-fold locks 552 do not interfere with the placement of the lid 530 on the upper lip 424 of the container 550. Alternatively or in conjunction, the anti-fold locks 552 are spaced a distance from the upper lip 424 so that the lid 530 can be placed on the container 550 without engaging the anti-fold locks.

In yet other embodiments (not shown), the collapsible containers disclosed herein, such as the containers 400, 520, and 550 may include one or more handles, pour spouts, and/or hangers. The container may have a non-skid surface on an exterior side of the bottom wall 26, such as with texture or adhesive. Denesting bumps may be added to an exterior or interior side of any of the side walls 28-34 near the upper edge 46 to keep the container when in the expanded position from sliding too tightly into another container that is also in the expanded position. The lids, such as lids 480 and 530 may include appropriately arranged detents to snap onto the bottom wall 26 of the container when in the expanded position to keep the lid with the container and to provide additional support for the bottom wall. The container and/or lid may also be fabricated out of materials including foam for insulation, susceptor materials for microwaveability, aluminum, and/or other metals.

Other embodiments of the invention including all the possible different and various combinations of the individual features of each of the foregoing described embodiments are specifically included herein.

INDUSTRIAL APPLICABILITY

A storage device having a collapsible container and lid according to the present invention may be used to store any of many types of items or substances. The collapsible container and lid may have any convenient size ranging from very small to very large. A specific potential use contemplated for the storage device is for the containment and storage of food products (not shown). The food products may be stored within the interior of the collapsible container when in the expanded position, and the lid is used to close the collapsible container. When no food products are stored in the storage device, the collapsible container may be collapsed to the collapsed position and placed within a recess in the lid to provide for convenient storage of the entire storage device in a compact form. The hold-open and hold-closed latches and the arched living hinges on the container help the container overcome problems associated with plastic memory in the hinges by helping maintain the container in both the expanded position and the collapsed position and still have a unitary thermoplastic container that is substantially leak proof at the living hinges. Further, brackets can be included to serve as handles for the container. Still further, hold down latches on the lid can interact with the brackets on the container to further secure the lid on the container in the expanded position. In another aspect of the collapsible container, stabilizers are disposed across hinges of the container to releasably lock the hinges in a bowed position that helps maintain the container in the expanded position. In another embodiment, anti-fold locks are disposed on the container to secure hinges against folding toward a collapsed position.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out the same. The exclusive right to all modifications within the scope of the impending claims is reserved.

We claim:

1. A container comprising:

a plurality of resilient wall panels, each wall panel connected to each adjacent wall panel at a hinged connection, wherein the wall panels are arranged so as to articulate at the hinged connections between a collapsed position and an expanded position comprising a bottom wall and four side walls extending upwardly from the bottom wall and defining an upper lip, and wherein at least one of the hinged connections between adjacent side walls is an arched hinge; and a downwardly projecting bracket disposed proximate the upper lip on an exterior side of a first side wall;

wherein at least one of the side walls comprises at least two wall panels defining a diagonal hinge extending substantially to diagonally opposite corners of the side wall.

2. The container of claim 1, wherein the bracket includes a detent disposed on a side of the bracket, and wherein the detent extends below a lower portion of the bracket.

3. The container of claim 1, wherein the bracket is spaced from the side wall a distance substantially coextensive with a horizontal protrusion of the upper lip.

4. The container of claim 1, wherein the bracket extends downwardly from the upper lip at an acute angle with respect to the side wall.

5. The container of claim 1, wherein the bracket is secured to the container by stabilizing flanges on opposite side edges of the bracket, and wherein the bracket includes a flexible central portion between the stabilizing flanges that is adapted to compress inwardly toward the side wall.

6. The container of claim 1, further comprising a stabilizing flange that is connected to the side wall and to a generally centered upper portion of the bracket.

7. The container of claim 1, further comprising a second downwardly projecting bracket disposed proximate the upper lip on an exterior side of a second side wall opposite the first side wall.

8. The container of claim 7, wherein each of the brackets includes detents disposed on opposite sides of the bracket and the detents extend below a lower portion of the bracket.

9. The container of claim 7, wherein each of opposing third and fourth side walls connecting the first and second side walls, respectively, comprises at least two wall panels defining a diagonal hinge extending substantially between diagonally opposite corners of the first and second adjacent side walls.

10. A container comprising:

a bottom wall and four side walls, each wall comprising one or more resilient wall panels, and each wall panel connected to each adjacent wall panel by a living hinge, wherein the wall panels and the living hinges are a unitary piece of material, and a first one of the living hinges connecting adjacent side walls has a non-linear axis of articulation;

wherein the container has an expanded position in which the side walls extend upwardly from the bottom wall and define an upper lip, the container has a substantially flat collapsed position, and the wall panels are arranged so as to articulate at each living hinge between the expanded position and the collapsed position; and a bracket carried by a first one of the side walls, wherein the bracket is spaced away from the first side wall and projects downwardly from the upper lip;

wherein the first side wall comprises at most one wall panel, and each of the bottom wall and second and third ones of the side walls attached to the first side wall comprises at most two wall panels with an axis of articulation of the living hinge therebetween oriented diagonally to extend substantially to opposite diagonal corners of the wall.

11. The container of claim 10, further comprising a horizontal flange protruding outwardly along the upper lip of the first side wall and extending from one end of the upper lip to an opposite end of the upper lip.

12. The container of claim 11, wherein the bracket is flush with an outer edge of the horizontal flange.

13. The container of claim 12, wherein the horizontal flange tapers from a first width at a center of the upper lip to a second, narrower width near an end of the upper lip.

* * * * *